US010415273B2

(12) United States Patent
Callan et al.

(10) Patent No.: US 10,415,273 B2
(45) Date of Patent: Sep. 17, 2019

(54) LOCKING APPARATUS, SYSTEMS, AND METHODS OF USE

(71) Applicant: Microsoft Technology Licensing, LLC, Redmond, WA (US)

(72) Inventors: Casey S. Callan, Seattle, WA (US); Spencer Bo Eggert, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 418 days.

(21) Appl. No.: 15/183,263

(22) Filed: Jun. 15, 2016

(65) Prior Publication Data

US 2017/0362858 A1 Dec. 21, 2017

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC ..... E05B 69/00; E05B 73/00; E05B 73/0082; E05B 73/0005
USPC ..... 70/14, 58, 423, 424, 431
See application file for complete search history.

(56) References Cited

U.S. PATENT DOCUMENTS 934,928 A * 9/1909 Michel ..... E05B 17/14 70/423
4,527,405 A * 7/1985 Renick ..... G11B 33/005 70/14
4,738,428 A * 4/1988 Themistos ..... E05B 73/0082 24/596.1
5,361,610 A * 11/1994 Sanders ..... G11B 33/005 248/552
5,390,514 A * 2/1995 Harmon ..... G11B 33/005 70/14
5,446,618 A * 8/1995 Tetsuya ..... E05B 73/0005 292/148
5,608,605 A * 3/1997 Siow ..... E05B 73/0005 361/679.43

(Continued)

OTHER PUBLICATIONS

Broussard, Mitchel, "Kensington Unveils 'MiniSaver Mobile Lock' for Use With Ultra-Thin Laptops and Tablets", Published on: Jan. 6, 2015 Available at: http://www.macrumors.com/2015/01/06/kensington-minisaver-mobile-lock/.

(Continued)

*Primary Examiner* — Suzanne L Barrett
(74) *Attorney, Agent, or Firm* — Ray Quinney & Nebeker P.C.; Paul N. Taylor

(57) ABSTRACT

A locking apparatus is described. The locking apparatus includes a first sliding member that includes a first locking arm that extends from the first sliding member, a first tab that extends from the first locking arm, and a first locking aperture assembly. The locking apparatus includes a second sliding member that includes a second locking arm that extends from the second sliding member and a second locking aperture assembly configured to cooperate with the first locking aperture assembly to form an aperture configured to prevent relative motion between the first sliding member and the second sliding member when a locking protrusion is inserted therethrough. A locking system and a kit for securing a computing device are described. Methods of use are also provided.

20 Claims, 17 Drawing Sheets

(56) References Cited

U.S. PATENT DOCUMENTS 5,719,731 A * 2/1998 Harmon ..... E05B 73/0005 360/137
5,875,657 A * 3/1999 Kelley ..... E05B 73/0005 248/553
5,907,962 A * 6/1999 Smithson ..... E05B 67/383 70/14
5,987,937 A * 11/1999 Lee ..... E05B 73/0005 248/553
6,006,557 A * 12/1999 Carl ..... E05B 73/0005 70/14
6,094,949 A * 8/2000 Lagerberg ..... E05B 73/0005 292/283
6,178,089 B1 * 1/2001 Alfonso ..... E05B 73/0005 361/727
6,389,854 B1 * 5/2002 Huang ..... E05B 73/0082 70/14
6,742,366 B1 * 6/2004 Lai ..... E05B 37/025 70/30
D553,945 S * 10/2007 Misner ..... D8/330
7,497,103 B1 * 3/2009 Misner ..... E05B 63/14 292/129
7,549,308 B2 6/2009 Avganim
7,997,106 B2 8/2011 Mahaffey et al.
8,107,236 B2 * 1/2012 Lin ..... E05B 73/0082 248/551
8,111,511 B2 * 2/2012 Ruch ..... G06F 21/88 248/166
8,456,836 B2 * 6/2013 Allen ..... E05B 73/0082 211/8
8,640,511 B1 2/2014 Derman
8,842,422 B2 9/2014 Hung et al.
8,844,329 B2 * 9/2014 Anderson ..... E05B 73/0005 70/14
8,869,573 B2 * 10/2014 Myers ..... E05B 73/0005 70/14
9,013,865 B2 * 4/2015 Chen ..... H05K 5/0217 361/679.21
9,598,883 B1 * 3/2017 Avganim ..... E05B 73/0082
2003/0029208 A1 2/2003 Merrem et al.
2004/0040350 A1 * 3/2004 Derman ..... E05B 73/0005 70/58
2004/0057197 A1 * 3/2004 Hill ..... G06F 1/1601 361/679.06
2006/0117814 A1 6/2006 Francke
2008/0072633 A1 * 3/2008 Samuel ..... E05B 67/003 70/58
2010/0192642 A1 8/2010 Hung et al.
2010/0320884 A1 * 12/2010 Shiroishi ..... E05B 73/0082 312/223.1
2014/0353453 A1 * 12/2014 Quijano ..... F16M 11/18 248/419

OTHER PUBLICATIONS

Spiwak, Marc, "Prevent Computer Theft with Kensington Locks and Other Security Devices", Published on: Jul. 18, 2015 Available at: http://www.bhphotovideo.com/explora/computers/tips-and-solutions/prevent-computer-theft-kensington-locks-and-other-security-devices.

"Lenovo" Retrieved on: Mar. 31, 2016 Available at: http://www.lenovo.com/images/gallery/1060x596/lenovo-all-in-one-desktop-c40-30-black-side-closeup-15.jpg.

* cited by examiner

LOCKING APPARATUS, SYSTEMS, AND METHODS OF USE

BACKGROUND

Background and Relevant Art

Computing devices are becoming increasingly portable. In addition, advances in technology have allowed for increasing capabilities in computing devices, such as processing power. Hence, computing devices are increasing in value. Therefore, this description relates to locking apparatus for securing a computing device.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

In one embodiment, a locking apparatus is described. The locking apparatus includes a first sliding member. The first sliding member includes a first locking arm extending from the first sliding member. The first sliding member includes a first tab extending from the first locking arm. The first sliding member includes a first locking aperture assembly. The locking apparatus includes a second sliding member that includes a second locking arm extending from the second sliding member. The second sliding member is connected to the first sliding member such that the first sliding member is slideable relative to the second sliding member in a sliding direction. The second sliding member includes a second locking aperture assembly configured to cooperate with the first locking aperture assembly to form an aperture configured to prevent relative motion between the first sliding member and the second sliding member when a locking protrusion is inserted therethrough in a locked configuration and allow relative motion between the first sliding member and the second sliding member when the locking protrusion is removed in an unlocked configuration.

In one embodiment, a locking system is described. The locking system includes a computing device having a first locking receptacle and a second locking receptacle. The locking system includes a locking apparatus with a first sliding member and a second sliding member. The first sliding member includes a first locking arm extending from the first sliding member, a first tab extending from the first locking arm, and a first locking aperture assembly. The first tab is configured to engage the first locking receptacle of the computing device. The second sliding member is connected to the first sliding member such that the first sliding member is configured to slide relative to the second sliding member in a sliding direction. The second sliding member includes a second locking arm extending from the second sliding member and a second tab extending from the second locking arm. The second tab is configured to engage the second locking receptacle of the computing device such that when the locking apparatus is in a locked configuration the first tab and the second tab cooperate to limit relative motion between the locking apparatus and the computing device in a direction transverse to the sliding direction. The second locking arm is configured to engage the computing device such that the first locking arm and the second locking arm cooperate to limit relative motion between the locking apparatus and the computing device in the sliding direction in the locked configuration. The second locking arm includes a second locking aperture assembly configured to cooperate with the first locking aperture assembly to form an aperture. The first locking aperture assembly and the second locking aperture assembly are configured to allow relative motion between the first sliding member and the second sliding member in an unlocked configuration. The locking system includes a locking protrusion that is configured to extend into and through the aperture in the locked configuration and configured to engage at least a portion of the aperture to prevent relative motion in the sliding direction between the first sliding member and the second sliding member in the locked configuration.

In one embodiment, a kit for securing a computing device is described. The kit includes a locking apparatus and a locking protrusion. The locking apparatus includes a first sliding member and a second sliding member. The first sliding member includes a first locking arm extending from the first sliding member, a first tab extending from the first locking arm, and a first locking aperture assembly. The second sliding member includes a second locking arm extending from the second sliding member. The second sliding member is connected to the first sliding member such that the first sliding member is configured to slide relative to the second sliding member in a sliding direction. The first tab is configured to engage one or more locking receptacles of a computing device such that when the locking apparatus is in a locked configuration the first tab limits relative motion between the locking apparatus and the computing device in a first direction. The second locking arm is configured to engage the computing device such that the first locking arm and the second locking arm cooperate to limit relative motion between the locking apparatus and the computing device in a second direction. The second sliding member includes a second locking aperture assembly configured to cooperate with the first locking aperture assembly to form an aperture with a top surface, a bottom surface, a left surface, and a right surface in a locked configuration, the first locking aperture assembly and the second locking aperture assembly configured to allow relative motion between the first sliding member and the second sliding member in an unlocked configuration. The locking protrusion is configured to extend into and through the aperture in the locked configuration and configured to engage at least a portion of the aperture to prevent relative motion between the first sliding member and the second sliding member in the locked configuration.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a top view of an embodiment of a locking apparatus in a locked configuration;

FIG. 2-2 is a back view of the embodiment of a locking apparatus of FIG. 2-1 in the locked configuration;

FIG. 2-3 is a top view of the embodiment of a locking apparatus of FIG. 2-1 in an unlocked configuration;

FIG. 2-4 is a back view of the embodiment of a locking apparatus of FIG. 2-1 in the unlocked configuration FIG. 2-5 is an isometric view of a locking protrusion assembly;

FIG. 2-6 is a detailed isometric view of the embodiment of a locking protrusion assembly of FIG. 2-5 in an unlocked configuration;

FIG. 2-7 is a detailed isometric view of the embodiment of a locking protrusion module of FIG. 2-5 in a locked configuration;

FIG. 2-8 is a partial top view of the embodiment of a locking protrusion assembly of FIG. 2-5 and the embodiment of a locking apparatus of FIG. 2-1 with both in the locked configuration;

FIG. 3-1 is an isometric top view of an embodiment of a first sliding member;

FIG. 3-2 is an isometric top view of an embodiment of a second sliding member;

FIG. 3-3 is an isometric top view of an embodiment of a locking apparatus in a locked configuration with the sliding members of FIGS. 3-1 and 3-2;

FIG. 3-4 is an isometric top view of the embodiment of a locking apparatus of FIG. 3-3 in an unlocked configuration;

FIG. 3-5 is an isometric back bottom view of an embodiment of a locking system with the embodiment of a locking apparatus of FIG. 3-3 attached to an embodiment of a base module in a locked configuration;

FIG. 4-1 is an isometric top view of an embodiment of a first sliding member;

FIG. 4-2 is an isometric top view of an embodiment of a second sliding member;

FIG. 4-3 is an isometric top view of an embodiment of a locking apparatus in a locked configuration with the sliding members of FIGS. 4-1 and 4-2;

FIG. 4-4 is an isometric top view of the embodiment of a locking apparatus of FIG. 4-3 in an unlocked configuration;

FIG. 4-5 is an isometric back bottom view of an embodiment of a locking system with the embodiment of a locking apparatus of FIG. 4-3 attached to an embodiment of a base module in a locked configuration;

FIG. 5-1 is an isometric top view of an embodiment of a locking apparatus in a locked configuration;

FIG. 5-2 is a partially exploded, isometric top view of the embodiment of a locking apparatus of FIG. 5-1 in the locked configuration;

FIG. 5-3 is an isometric top view of the embodiment of a locking apparatus in FIG. 5-1 in an unlocked configuration;

FIG. 5-4 is a partially exploded, isometric top view of the embodiment of a locking apparatus of FIG. 5-1 in an unlocked configuration;

FIG. 5-5 is a top view of an embodiment of a locking system with the embodiment of a locking apparatus of FIG. 5-1 attached to an embodiment of a base module with an electronic component in a locked configuration;

FIG. 5-6 is a partially cutaway right view of the embodiment of a locking system of FIG. 5-5 attached to an embodiment of a base module in a locked configuration;

FIG. 6-1 is an isometric top view of an embodiment of a locking apparatus in a locked configuration;

FIG. 6-2 is an isometric top view of the embodiment of a locking apparatus in FIG. 6-1 in an unlocked configuration;

FIG. 7-1 is an isometric top view of an embodiment of a locking apparatus in a locked configuration;

FIG. 7-2 is an isometric top view of the embodiment of a locking apparatus in FIG. 7-1 in an unlocked configuration;

FIGS. 7-3 and 7-4 are isometric top views of the embodiment of a locking apparatus in FIG. 7-1 with the base member and the first locking assembly in phantom in the locked configuration and the unlocked configuration, respectively;

FIG. 7-5 is a partially cutaway right view of the embodiment of a locking system attached to an embodiment of a base module in a locked configuration;

FIG. 7-6 is an isometric top view of the embodiment of the locking system of FIG. 7-5 with the embodiment of a locking apparatus of FIG. 7-1 attached to an embodiment of a base module with an electronic component and an embodiment of a locking protrusion assembly;

FIG. 8-1 is an isometric top view of an embodiment of a locking apparatus in a locked configuration;

FIG. 8-2 is an isometric top view of the embodiment of a locking apparatus in FIG. 8-1 in the locked configuration with an upper base member in phantom;

FIG. 8-3 is an isometric top view of the embodiment of a locking apparatus in FIG. 8-1 in an unlocked configuration;

FIG. 8-4 is an isometric top view of the embodiment of a locking apparatus in FIG. 8-1 in an unlocked configuration with the upper base member in phantom;

FIG. 8-5 is a partially cutaway isometric bottom view of the embodiment of a locking system attached to an embodiment of a base module in a locked configuration; and FIGS. 8-6 through 8-8 are isometric top views of the embodiment of the locking system and base module of FIG. 8-5 with the embodiment of a locking apparatus of FIG. 8-1 attached in locked, unlocked, and undocked configurations, respectively.

DETAILED DESCRIPTION

This disclosure generally relates to locking apparatuses, systems, and methods. More particularly, this disclosure generally relates to locking apparatuses, systems, and methods for securing computing devices.

Figure 1:
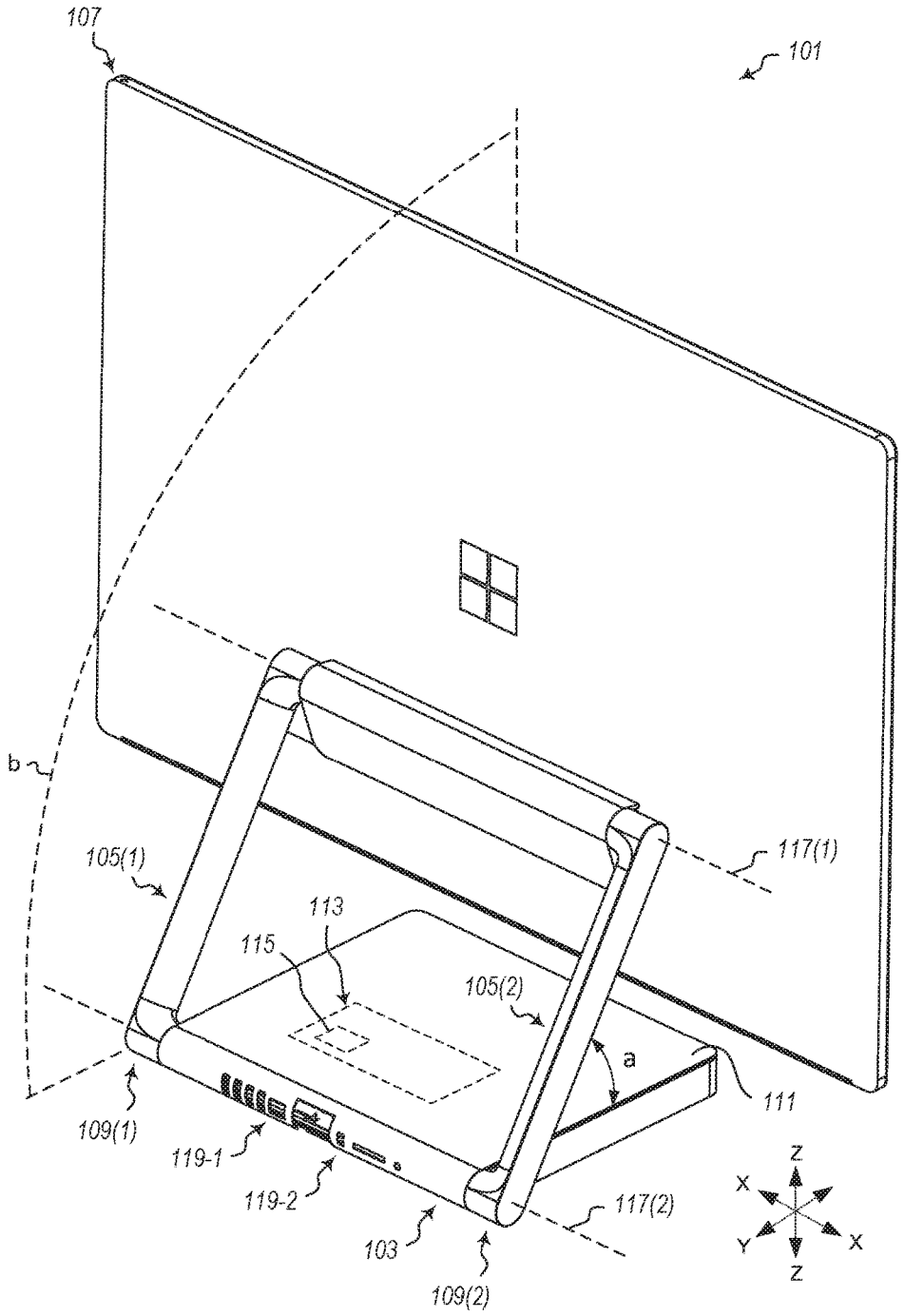
FIG. 1 is an isometric view of an embodiment of a computing device.

FIG. 1 illustrates an embodiment of a computing device 101 that includes a base assembly 103, an arm assembly 105, and a display assembly 107 that includes a display. The base assembly 103 can include a base module 109 and a housing 111 that can contain various electronic components 113, such as a processor 115 for controlling the display. Other electronic components 113 may include power components, memory components, storage components, thermal management components, other electronic components, or combinations thereof.

Controlling the display can be achieved wirelessly or via conductors (not shown) that travel from the base assembly 103 to the display assembly 107 via the arm assembly 105. Note that there are actually two arm assemblies 105(1) and 105(2) and two base modules 109(1) and 109(2) (e.g., left and right), but these elements can generally be discussed interchangeably or generically in the description below. As a result, the suffix (e.g., "(1)" or "(2)" may not be used strictly in the following description and drawings.

The arm assembly 105 can rotatably couple the display assembly 107 to the base assembly 103 by providing upper and lower axes of rotation 117(1) and 117(2). Specifically, rotation around the lower axis of rotation 117(2) can define an angle alpha or 'α' between the arm assembly 105 and the base assembly 103 (e.g., between the arm assembly and a horizontal surface upon which the device is positioned). Rotation around the upper and lower axes of rotation 117(1) and 117(2) can define an angle beta or 'β' between the display assembly 107 and the horizontal surface. An example computing device 101 may be found in U.S. patent application Ser. No. 15/098,947 filed Apr. 14, 2016, which is hereby incorporated by reference in its entirety.

The computing device 101 may include one or more locking receptacles 119. In the illustrated embodiment, the computing device 101 includes a first locking receptacle 119(1) and a second locking receptacle 119(2). In other embodiments, more or fewer locking receptacles 119 may be used. The locking receptacles 119 may be engaged by a locking apparatus, as will be described herein. Due to the size of the base module 109 and/or housing 111, the electronic components 113 may be closely spaced. For example, one or more electronic components 113 may be separated by less than 1 mm. Thus, the locking receptacles 119 may be disposed in a plane that is offset from a plane of the electronic components 113. In other words, in embodiments with circuit boards or other electrical connectors, the circuit board may be offset from a plane through the locking receptacles 119. In some embodiments, one or more electronic components 113 may be aligned in another plane relative to the locking receptacles. Such configurations may allow access to the electronic components 113 without interference with the locking apparatus. As shown more fully below, for example in FIG. 5-6, the locking receptacles 119 may be located below the base assembly 103 to effectively hide the locking receptacles 119 from view while preserving accessibility.

Although the computing device 101 shown in FIG. 1 is shown with the display assembly 107 connected to the base assembly 103, in other embodiments, the display assembly 107 may be separate from the base assembly 103. In further embodiments, the electronic components 113 may be housed within the display assembly 107 such as in a mobile communication device (e.g., a mobile telephone, table computer, or other mobile communication device). Other example computing devices may include a gaming system, a smart television, a laptop computer, a notebook computer, a standalone display intended for use with a computing device, or other computing devices.

Referring generally to FIGS. 2-1 through 2-8, the locking apparatus 200 may be used to secure a computing device 101. The locking apparatus 200 may connect to the computing device 101 in combination with one or more locking receptacles (e.g., locking receptacles 119) on, for instance, the base assembly 103. In other embodiments, the locking apparatus 200 may connect to another component of the computing device 101 (e.g., using one or more locking receptacles 119).

The locking apparatus 200 may include a first sliding member 202(1) and a second sliding member 202(2). The first sliding member 202(1) and the second sliding member 202(2) may be connected such that the first sliding member 202(1) is slidable relative to the second sliding member 202(2) in a sliding direction (e.g., shown by the arrows in FIGS. 2-1 and 2-3). For example, the first sliding member 202(1) is shown with a channel 204 and the second sliding member 202(2) is shown with a slider 206. Slidable movement may include ratcheting or other types of movement. The first sliding member 202(1) and the second sliding member 202(2) may simply move relative to each other.

The slider 206 may move within the channel 204. The channel 204 may include one or more surfaces (not labeled) to limit the motion of the slider 206 within the channel 204. For example, the slider 206 is shown abutting a left surface (not labeled) in FIG. 2-1, abutting a right surface (not labeled) in FIG. 2-3, and abutting both a front surface (not labeled) and a back surface (not labeled) in both FIGS. 2-1 and 2-3. In other embodiments, the slider 206 may not necessarily abut any surfaces of the channel 204. However, the channel 204 may limit the motion of the slider 206 in both the sliding direction and in the front and back direction (e.g., up and down on the page in FIGS. 2-1 and 2-3).

The channel 204 is shown as being straight and parallel to the sliding direction. In other embodiments, the channel 204 may be curved, such that the sliding direction extends about the curve of the channel 204.

A cap (not shown) or other element may be secured to the slider 206 to cooperate with the second sliding member 202(2) to limit relative movement of the first sliding member 202(1) and the second sliding member 202(2) in a direction transverse to the sliding direction. For example, the first sliding member 202(1) and the second sliding member 202(2) may be limited from moving in the top and bottom direction (e.g., up and down on the page in FIGS. 2-2 and 2-4). Although the channel 204 is shown as incorporated into the first sliding member 202(1) and the slider 206 is shown as incorporated into the second sliding member 202(2), the channel 204 may be incorporated into the second sliding member 202(2) and the slider 206 may be incorporated into the first sliding member 202(1).

Figures 1, 2:
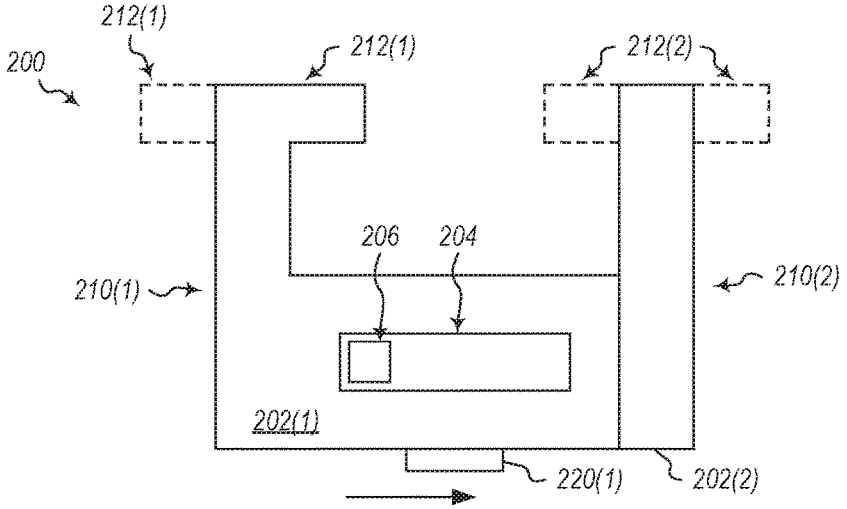
Figure 2:
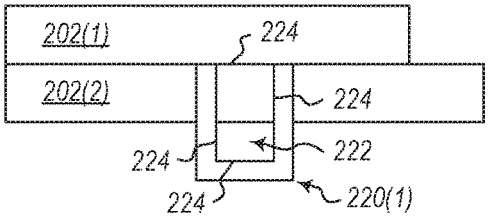
Figures 2, 3:
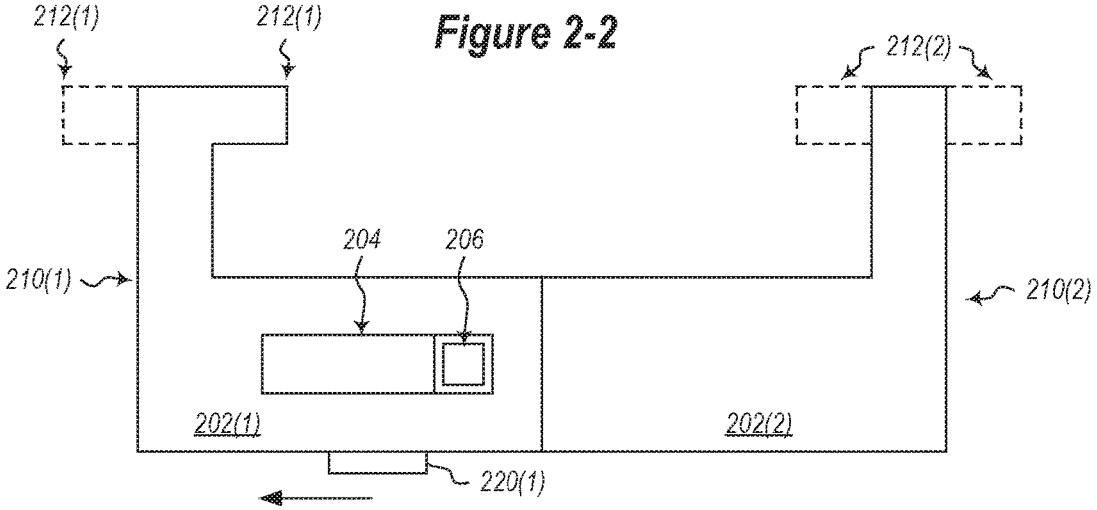

The first sliding member 202(1) includes a first locking arm 210(1) and the second sliding member 202(2) includes a second locking arm 210(2). The locking arms 210 may be connected to and/or be integral with their respective sliding members 202. The locking arms 210 may extend from their respective sliding members 202 in a direction transverse to the sliding direction. As shown in FIGS. 2-1 and 2-3, the locking arms 210 extend perpendicular to and extend straight from the sliding members 202. In other embodiments, the locking arms 210 may extend at another angle to and/or may extend in a curved path from the sliding members 202.

One or more of the locking arms 210 may include a tab 212. As shown in FIGS. 2-1 and 2-3, the first locking arm 210(1) includes a first tab 212(1). The first tab 212(1) is shown extending transverse from the first locking arm 210(1) toward the second locking arm 210(2). In other embodiments, the first tab 212(1) may extend away from the second locking arm 210(2), as shown in phantom.

The second locking arm 210(2) is illustrated without a tab 212, although in some embodiments, as is shown in phantom, the second locking arm 210(2) may include a second tab 212(2) that may extend toward or away from the first locking arm 210(1), as shown in phantom.

One or more tabs 212 may be configured to engage one or more locking receptacles (e.g., locking receptacles 119 shown in FIG. 1), as will be described in more detail herein. In embodiments where the tabs 212 are directed toward each other, a distance between the locking arms 210 may be smaller in the locked configuration and larger in the unlocked configuration. In other words, the locking arms 210 may move toward each other as they transition from the unlocked configuration toward the locked configuration. In embodiments where the tabs are directed away from each other, the distance between the locking arms 210 may be smaller in the unlocked configuration and larger in the locked configuration. In other words, the locking arms 210 may move away from each other as they transition from the unlocked configuration toward the locked configuration.

As the first sliding member 202(1) moves away from the second sliding member 202(2), the first locking arm 210(1) moves away from the second locking arm 210(2), as can be seen in FIGS. 2-1 and 2-3. The ability to move apart, allows the locking apparatus 200 to transition from the locked configuration of FIGS. 2-1 and 2-2 toward the unlocked configuration of FIGS. 2-3 and 2-4 and vice versa.

The first sliding member 202(1), the first locking arm 210(1), and the first tab 212(1) and the second sliding member 202(2), the second locking arm 210(2), and in embodiments with a second tab 212(2), the second tab 212(1), may lie within separate planes (e.g., a first plane extending through the first sliding member 202(1), the first locking arm 210(1), and the first tab 212(1) and a second plane extending through the second sliding member 202(2) and the second locking arm 210(2) (and the second tab 212(2))). In embodiments where the sliding members 202, locking arms 210, and one or more tabs 212 lie within their respective planes, any locking receptacles (e.g., locking receptacles 119) may need to be offset to receive their respective tabs 212 and/or locking arms 210.

In other embodiments, one or more of the locking arms 210 may be in a different plane than one or more of the sliding members 202. For example, as shown in FIGS. 3-2 through 3-5, the second locking arm 310(2) bends upward (e.g., toward the top) from the second sliding member 302(2) to the second tab 312(2). In other embodiments, both the first and second locking arms may be bent such that the locking arms are in a different plane than the sliding members. In embodiments where the tabs 312 are within the same plane, openings in the locking receptacles may lie within the same plane.

Figures 2, 3, 4:
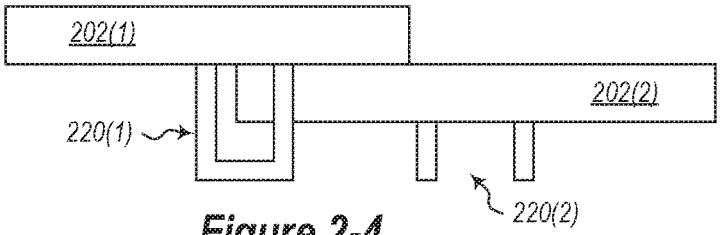

The sliding members 202 may include locking aperture assemblies 220. The first sliding member 202(1) is shown with a first locking aperture assembly 220(1). The second sliding member 202(2) is shown with a second locking aperture assembly 220(2). The locking aperture assemblies 220 may cooperate to form an aperture 222, as best seen in FIG. 2-2. For example, as shown in FIGS. 2-2 and 2-4, the first locking aperture assembly 220(1) forms a rectangular opening and the second locking aperture assembly 220(2) forms a rectangular opening with an open bottom (e.g., two posts that are spaced apart). The first locking aperture assembly 220(1) is the backmost assembly and the second locking aperture assembly 220(2) is the frontmost assembly, such that when the locking apparatus 200 is in the locked configuration of FIGS. 2-1 and 2-2, the locking aperture assemblies 220 at least partially overlap.

FIGS. 2-5 through 2-7 illustrate an embodiment of a locking protrusion assembly 280 that may be used with the locking apparatus 200 and/or with any other embodiment of a locking assembly described herein. FIG. 2-5 shows the complete locking protrusion assembly 280. The locking protrusion assembly 280 includes a locking protrusion 290. The locking protrusion assembly 280 shown is a MiniSaver™ Mobile Keyed Lock available from Kensington Computer Products Group. Although a MiniSaver™ lock is shown, other locks may also be used.

The locking protrusion assembly 280 may include a lock 282 that may be locked and unlocked by keys 283. For example, the lock 282 may be a standard tumbler lock. In other embodiments other locks may be used. For example, a combination lock may be used.

The lock 282 may include an actuator 284. The actuator 284 is shown as a button actuator that may engage and disengage the locking protrusion 290. The actuator 284 may be connected to an actuation cable 285 that may actuate one or more components of the locking protrusion 290. When the lock 282 is locked, the actuator 284 may not disengage the locking protrusion 290. When the lock 282 is unlocked, the actuator 284 may disengage the locking protrusion 290.

The lock 282 may be connected to a locking cable 286 that may be connected to a locking attachment 287. The locking cable 286 may include a cut resistant cable. The locking attachment 287 may be formed by the locking cable 286. For example, as shown, the locking attachment 287 is a loop of locking cable 286 that is fastened together. In other embodiments, other locking attachments 287 may be used. A locking cable management mechanism 288 may be used to manage the overall length of the locking cable 286.

As shown more clearly in FIGS. 2-6 and 2-7, the locking protrusion 290 may move from an unlocked configuration shown in FIG. 2-6 toward a locked configuration shown in FIG. 2-7. The locking protrusion 290 may include one or more aperture engaging members 292. As shown, the locking protrusion 290 includes a first aperture engaging member 292(1) and a second aperture engaging member 292(2). In other embodiments more or fewer aperture engaging members 292 may be used. The aperture engaging members 292 may abut a locking support member 294. The locking support member 294 may add additional strength to the aperture engaging members 292.

The aperture engaging members 292 may extend through a locking aperture assembly engaging member 296. The locking aperture assembly engaging member 296 may provide support for one or more components of the locking protrusion 290. For example, for components that may not be capable of withstanding transverse forces (e.g., forces nonparallel to a component's longitudinal axis), the locking aperture assembly engaging member 296 may absorb such lateral forces.

The aperture engaging members 292 may initially be extended in the unlocked configuration and may move toward the locking attachment 287 in the locked configuration to lock the locking apparatus 200, as can best be seen in FIG. 2-8.

Referring to FIG. 2-8, the aperture (e.g., aperture 222 shown in FIG. 2-2) formed by the locking aperture assemblies 220 may limit movement of the sliding members 202 when the locking protrusion 290 is inserted into the aperture 222. For example, the locking aperture assemblies 220 may form an aperture 222 with a continuous inner surface 224. In other words, one or more surfaces of the locking aperture assemblies 220 may form a top surface, a bottom surface, a left surface, and a right surface of the inner surface 224. In another example, the inner surface 224 of the aperture 222 may be unbroken 360 degrees about a longitudinal axis of the aperture 222.

The inner surface 224 may abut the locking protrusion 290 such that when a lateral force (e.g., lateral to a longitudinal axis of the locking protrusion) is applied, the inner surface 224 resists the force. For example, as shown in FIG. 2-8, the inner surface 224 may abut the first aperture engaging member 292(1) and the second aperture engaging member 292(2).

The aperture engaging members 292 may engage the front surface (e.g., the topmost surface of the second locking aperture assembly 220(2) as shown in FIG. 2-8) of the aperture 222. For example, the aperture engaging members 292 may have a transverse portion 292-1 (e.g., a portion extending away from a longitudinal axis of the aperture engaging members 292) that engages the front surface of the aperture 222. The locking aperture assembly engaging member 296 may engage the back surface (e.g., the bottommost surface of the first locking aperture assembly 220(1) as shown in FIG. 2-8) of the aperture 222. As the aperture engaging members 292 retract, the aperture engaging members 292 and the locking aperture assembly engaging member 296 may engage the aperture 222. Thus, the aperture engaging members 292 and the locking aperture assembly engaging member 296 may lock the locking apparatus 200. Specifically, the aperture engaging members 292 may prevent the locking arms 210 from moving apart (or together).

Referring generally to FIGS. 3-1 through 3-5, the locking apparatus 300 may be used to secure a computing device (e.g., computing device 101). The locking apparatus 300 may include a first sliding member 302(1), as best seen in FIG. 3-1, and a second sliding member 302(2), as best seen in FIG. 3-2. The first sliding member 302(1) includes a channel 304 and the second sliding member 302(2) includes a first slider 306(1) and a second slider 306(2). The first slider 306(1) may abut a left surface of the channel 304 and the second slider 306(2) may abut a right surface of the channel 304. Both sliders 306 may abut a front and back surface of the channel 304.

Both sliding members 302 include stops 308. The first stop 308(1) is configured to abut at least a portion of a leftmost surface of the second sliding member 302(2) and the second stop 308(2) is configured to abut at least a portion of a rightmost surface of the first sliding member 302(1). The stops 308 may be configured to abut the respective surface of the other sliding member 302 at the same time that one of the sliders 306 abuts the respective surface of the channel 304. For example, in the unlocked configuration of FIG. 3-4, the right slider 306(2) abuts the rightmost surface of the channel 304 at the same time that the first stop 308(1) abuts the leftmost surface of the second sliding member 302(2) and at the same time that the second stop 308(2) abuts the rightmost surface of the first sliding member 302(1). The stops 308 may limit twisting and/or bending of the sliding members 302.

The first sliding member 302(1) includes a first locking arm 310(1) and the second sliding member 302(2) includes a second locking arm 310(2). The locking arms 310 may be connected to and/or be integral with their respective sliding members 302. The locking arms 310 may extend from their respective sliding members 302 in a direction transverse to the sliding direction.

The locking arms 310 may include tabs 312. As shown, the first tab 312(1) and the second tab 312(2) extend away from each other and away from their respective locking arms 310. Thus, the locking arms 310 move toward each other as they transition from the locked configuration to the unlocked configuration and move away from each other as they transition from the unlocked configuration to the locked configuration.

Figures 2, 3, 4, 5:
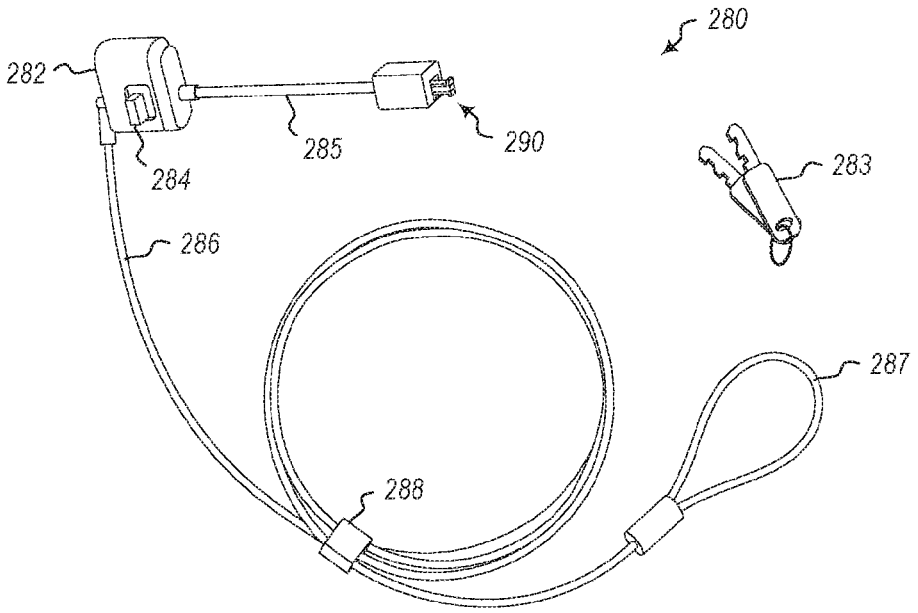

As shown in FIG. 3-5, the locking apparatus 300 may connect to an embodiment of a base module 309. In other embodiments, the locking apparatus 300 may connect to another component of a computing device (e.g., computing device 101).

The tabs 312 are configured to engage respective locking receptacles 319. The first tab 312(1) may be inserted into the first locking receptacle 319(1) and the second tab 312(2) may be inserted into the second locking receptacle 319(2). The tabs 312 and the locking receptacles 319 may be sized and shaped such that the back surface of tabs 312 abuts the front facing inner surface of the locking receptacles 319. This abutting engagement may limit relative motion of the locking apparatus 300 and the base module 309 in the front and back direction. Where the locking receptacles 319 are sized such that a small clearance (e.g., between 0.1 mm and 0.5 mm) between a top surface and a bottom surface of the tabs 312 and a bottom facing surface and a top facing surface of the locking receptacles 319, the locking receptacles 319 may limit relative motion of the locking apparatus 300 in the top and bottom directions. In addition, the depth of the locking receptacles 319 and/or the length of the tabs 312 may be sufficient to resist torques applied to the locking apparatus 300. For example, the tabs 312 may have a length of between 1 mm and 5 mm. In one example, the tabs 312 may have a length of 3.55 mm.

As shown in FIGS. 3-2 through 3-4, the first locking arm 310(1) extends perpendicular to and straight from the first sliding member 302(1) such that the first sliding member 302(1), the first locking arm 310(1), and the first tab 312(1) lie within the same plane. The second locking arm 310(2) is shown extending perpendicular to the second sliding member 302(2), however, the second locking arm 310(2) extends toward the top of the locking apparatus 300 such that the second tab 312(2) lies within the same plane as the first sliding member 302(1), the first locking arm 310(1), and the first tab 312(1) while the second sliding member 302(2) lies within a separate plane. As described above, having both tabs 312 lying within the same plane allows for the locking receptacles to be similarly shaped and arranged (e.g., may be mirror images of each other, as shown).

The sliding members 302 may include locking aperture assemblies 320. The first sliding member 302(1) is shown with a first locking aperture assembly 320(1). The second sliding member 302(2) is shown with a second locking aperture assembly 320(2). The locking aperture assemblies 320 may cooperate to form an aperture 322, as best seen in FIG. 3-3. For example, as shown, both the first locking aperture assembly 320(1) and the second locking aperture assembly 320(2) form corresponding rectangular openings. The first locking aperture assembly 320(1) is the frontmost assembly and the second locking aperture assembly 320(2) is the backmost assembly, such that when the locking apparatus 300 is in the locked configuration of FIG. 3-3, the locking aperture assemblies 320 at least partially overlap.

The aperture 322 formed by the locking aperture assemblies 320 may limit movement of the sliding members 302 when a locking protrusion (e.g., locking protrusion 290 shown in FIGS. 2-5 through 2-8) is inserted into the aperture 322. The locking aperture assemblies 320 may form an aperture 322 with a continuous inner surface 324. The inner surface 324 may abut the locking protrusion such that when a lateral force (e.g., lateral to a longitudinal axis of the locking protrusion) is applied, the inner surface 324 resists the force.

One or more components of the locking apparatus 300 described in connection with FIGS. 3-1 through 3-5 may be used instead of or in addition to one or more components of any locking apparatus described herein. For example, the stops 308 may be incorporated into one or more of the sliding members 202 described in connection with FIGS. 2-1 through 2-8. In another example, the second locking aperture assembly 220(2) that forms a rectangular opening with an open bottom (e.g., two posts that are spaced apart) may replace one of the locking aperture assemblies 320 described in connection with FIGS. 3-1 through 3-5.

Referring generally to FIGS. 4-1 through 4-5, the locking apparatus 400 may be used to secure a computing device (e.g., computing device 101). The locking apparatus 400 may include a first sliding member 402(1), as best seen in FIG. 4-1, and a second sliding member 402(2), as best seen in FIG. 4-2. The first sliding member 402(1) includes a first slider 406(1) and a second slider 406(2) and the second sliding member 402(2) includes a channel 404. The first slider 406(1) may abut a left surface of the channel 404 and the second slider 406(2) may abut a right surface of the channel 404. Both sliders 406 may abut a front and back surface of the channel 404.

Both sliding members 402 include stops 408. The first stop 408(1) is configured to abut at least a portion of a leftmost surface of the second sliding member 402(2) and the second stop 408(2) is configured to abut at least a portion of a rightmost surface of the first sliding member 402(1). The stops 408 may be configured to abut the respective surface of the other sliding member 402 at the same time that one of the sliders 406 abuts the respective surface of the channel 404. The stops 408 may limit twisting and/or bending of the sliding members 402.

The first sliding member 402(1) includes a first locking arm 410(1) and the second sliding member 402(2) includes a second locking arm 410(2). The locking arms 410 may be connected to and/or be integral with their respective sliding members 402. The locking arms 410 may extend from their respective sliding members 402 in a direction transverse to the sliding direction.

The locking arms 410 may include tabs 412. As shown, the first tab 412(1) and the second tab 412(2) extend toward each other and toward their respective locking arms 410. Thus, the locking arms 410 move toward each other as they transition from the unlocked configuration to the locked configuration and move away from each other as they transition from the locked configuration to the unlocked configuration.

As shown in FIG. 4-5, the locking apparatus 400 may connect to an embodiment of a base module 409. In other embodiments, the locking apparatus 400 may connect to another component of a computing device (e.g., computing device 101).

The tabs 412 are configured to engage respective locking receptacles 419. The first tab 412(1) may be inserted into the first locking receptacle 419(1) and the second tab 412(2) may be inserted into the second locking receptacle 419(2). The tabs 412 and the locking receptacles 419 may be sized and shaped such that the back surface of tabs 412 abuts the front facing inner surface of the locking receptacles 419. This abutting engagement may limit relative motion of the locking apparatus 400 and the base module 409 in the front and back direction. Where the locking receptacles 419 are sized such that a small clearance between a top surface and a bottom surface of the tabs 412 and a bottom facing surface and a top facing surface of the locking receptacles 419, the locking receptacles 419 may limit relative motion of the locking apparatus 400 in the top and bottom directions. In addition, the depth of the locking receptacles 419 and/or the length of the tabs 412 may be sufficient to resist torques applied to the locking apparatus 400.

As shown, the first locking arm 410(1) extends perpendicular to and straight from the first sliding member 402(1) such that the first sliding member 402(1), the first locking arm 410(1), and the first tab 412(1) lie within the same plane. The second locking arm 410(2) is shown extending perpendicular to the second sliding member 402(2), however, the second locking arm 410(2) extends toward the top of the locking apparatus 400 such that the second tab 412(2) lies within the same plane as the first sliding member 402(1), the first locking arm 410(1), and the first tab 412(1) while the second sliding member 402(2) lies within a separate plane.

The sliding members 402 may include locking aperture assemblies 420. The first sliding member 402(1) is shown with a first locking aperture assembly 420(1). The second sliding member 402(2) is shown with a second locking aperture assembly 420(2). The locking aperture assemblies 420 may cooperate to form an aperture 422, as best seen in FIG. 4-3. The first locking aperture assembly 420(1) is the backmost assembly and the second locking aperture assembly 420(2) is the frontmost assembly, such that when the locking apparatus 400 is in the locked configuration of FIG. 4-3, the locking aperture assemblies 420 at least partially overlap.

The aperture 422 formed by the locking aperture assemblies 420 may limit movement of the sliding members 402 when a locking protrusion (e.g., locking protrusion 290 shown in FIGS. 2-5 through 2-8) is inserted into the aperture 422. The locking aperture assemblies 420 may form an aperture 422 with a continuous inner surface 424. The inner surface 424 may abut the locking protrusion such that when a lateral force (e.g., lateral to a longitudinal axis of the locking protrusion) is applied, the inner surface 424 resists the force.

One or more components of the locking apparatus 400 described in connection with FIGS. 4-1 through 4-5 may be used instead of or in addition to one or more components of any locking apparatus described herein. For example, the outwardly facing tabs 412 may be incorporated into one or more of the sliding members 302 described in connection with FIGS. 3-1 through 3-5. In another example, the second locking aperture assembly 220(2) that forms a rectangular opening with an open bottom (e.g., two posts that are spaced apart) may replace one of the locking aperture assemblies 420 described in connection with FIGS. 4-1 through 4-5.

Figures 2, 3, 4, 5, 6:
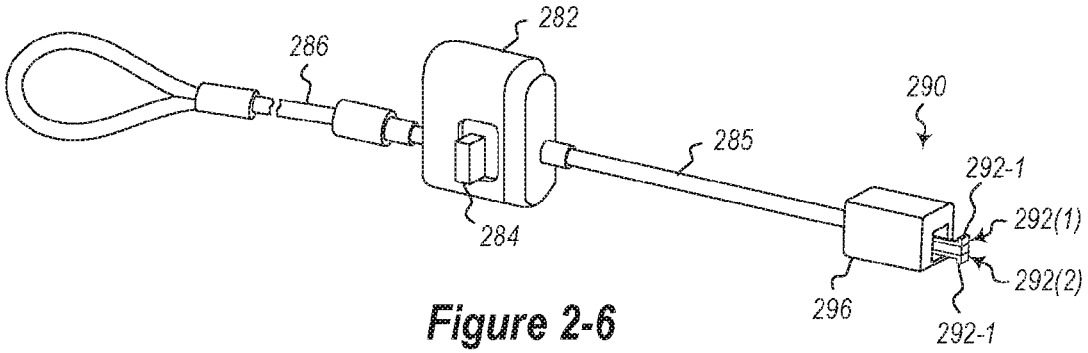

Referring generally to FIGS. 5-1 through 5-6, the locking apparatus 500 may be used to secure a computing device (e.g., computing device 101). The locking apparatus 500 of FIGS. 5-1 through 5-6 may be similar to the locking apparatuses described herein. Similar components may be similarly numbered.

The locking apparatus 500 may include two sliding members 502, as best seen in FIGS. 5-2 and 5-4. The second sliding member 502(2) includes a channel 504 and the first sliding member 502(1) includes a first slider 506(1) and a second slider 506(2). The sliding members 502 include locking arms 510 that may be connected to and/or be integral with their respective sliding members 502.

The first sliding member 502(1) includes an upper base member 514(1), shown in FIGS. 5-1 and 5-3, and a lower base member 514(2), best seen in FIGS. 5-2 and 5-4, which are connected to a first locking arm 510(1). The first slider 506(1) may abut a left surface of the channel 504 in the unlocked configuration, while the second slider 506(2) may be used for support. Both sliders 506 may abut a front and back surface of the channel 504. In some embodiments, a biasing member may be included within the channel 504 to bias the locking apparatus 500 toward the unlocked configuration.

The locking apparatus 500 may include a stop 508. The stop 508 may selectively abut a surface of the second sliding member 502(2). For example, the stop 508 abuts one of the right surfaces (not labeled) of the second sliding member 502(2) in FIGS. 5-1 and 5-2. The stop 508 may keep the locking apparatus 500 in the locked configuration with or without a locking protrusion (e.g., locking protrusion 290) in the aperture 522. Without the stop 508, the sliding members 502 may slide between the locked and unlocked configurations without externally applied forces. The stop 508 may be connected to a biasing member (e.g., spring 530). The biasing member may bias the stop 508 toward the locked configuration. For example, the biasing member may push the stop 508 toward the front of the locking apparatus 500.

The locking arms 510 may include tabs 512. As shown, the first tab 512(1) and the second tab 512(2) extend toward each other and toward their respective locking arms 510. Thus, the locking arms 510 move toward each other as they transition from the unlocked configuration to the locked configuration and move away from each other as they transition from the locked configuration to the unlocked configuration.

As shown, the locking arms 510 extend perpendicular to and straight from their respective sliding members 502 such that the sliding members 502, the locking arms 510, and the tabs 512 lie within the same plane, respectively. The first sliding member 502(1) and the second sliding member 502(2) are shown lying in the same plane.

The sliding members 502 may include locking aperture assemblies 520. The first sliding member 502(1) is shown with a first locking aperture assembly 520(1). The second sliding member 502(2) is shown with a second locking aperture assembly 520(2). The locking aperture assemblies 520 may cooperate to form an aperture 522, as best seen in FIG. 5-3. The first locking aperture assembly 520(1) is the backmost assembly and the second locking aperture assembly 520(2) is the frontmost assembly. The first locking aperture assembly 520(1) forms a rectangular opening. The second locking aperture assembly 520(2) includes a left and right surface, but as well as a front surface (e.g., back facing), but is open on the top and bottom.

The aperture 522 formed by the locking aperture assemblies 520 may limit movement of the sliding members 502 when a locking protrusion (e.g., locking protrusion 290 shown in FIGS. 2-5 through 2-8) is inserted into the aperture 522. The locking aperture assemblies 520 may form an aperture 522 with a continuous inner surface 524. The inner surface 524 may abut the locking protrusion such that when a lateral force (e.g., lateral to a longitudinal axis of the locking protrusion) is applied, the inner surface 524 resists the force.

As shown in FIGS. 5-5 and 5-6, the locking apparatus 500 may connect to an embodiment of a base module 509. In other embodiments, the locking apparatus 500 may connect to another component of a computing device (e.g., computing device 101).

The tabs 512 are configured to engage respective locking receptacles as described herein. The locking apparatus 500 may be aligned with the electronic component 513. For example, the electronic component 513 is shown as a power cord that is aligned vertically with the locking apparatus 500. Aligning the electronic component 513 with the locking apparatus 500 may reduce the footprint of the computing device (e.g., computing device 101). The locking apparatus 500 is shown in FIG. 5-6 as being vertically spaced with the electronic component 513.

One or more components of the locking apparatus 500 described in connection with FIGS. 5-1 through 5-6 may be used instead of or in addition to one or more components of any locking apparatus described herein. For example, the outwardly extending stop 508 may be incorporated into one or more of the locking apparatus 200, 300, 400 described in connection with FIGS. 2-1 through 4-5. In another example, the second locking aperture assembly 220(2) that forms a rectangular opening with an open bottom (e.g., two posts that are spaced apart) may replace one of the locking aperture assemblies 520 described in connection with FIGS. 5-1 through 5-6.

Referring generally to FIGS. 6-1 and 6-2, the locking apparatus 600 may be used to secure a computing device (e.g., computing device 101). The locking apparatus 600 of FIGS. 6-1 and 6-2 may be similar to the locking apparatuses described herein. Similar components may be similarly numbered.

The locking apparatus 600 may include two sliding members 602. The sliding members 602 include locking arms 610 that may be connected to and/or be integral with their respective sliding members 602. The locking arms 610 may include tabs 612. As shown, the first tab 612(1) and the second tab 612(2) extend toward each other and toward their respective locking arms 610. Thus, the locking arms 610 move toward each other as they transition from the unlocked configuration to the locked configuration and move away from each other as they transition from the locked configuration to the unlocked configuration.

As shown, the locking arms 610 extend perpendicular to and straight from their respective sliding members 602 such that the sliding members 602, the locking arms 610, and the tabs 612 lie within the same plane, respectively. The first sliding member 602(1) includes an upper base member 614(1), shown in FIG. 6-1, and a lower base member 614(2), best seen in FIG. 6-2, which are connected to a first locking arm 610(1).

The first sliding member 602(1) includes a first channel 604(1). The first channel 604(1) is aligned transverse to the sliding direction. As shown, the first channel 604(1) is orthogonal to the sliding direction. The second sliding member 602(2) includes a second channel 604(2). The second channel 604(2) includes a portion that is parallel to the first channel 604(1) and a second portion that is at least partially aligned with the sliding direction (e.g., at least partially transverse to the first portion).

A slider 606 rides within both the first channel 604(1) and the second channel 604(2). The configuration of the first channel 604(1) and the second channel 604(2) facilitates locking the locking apparatus 600 with the slider 606. For example, as shown in FIG. 6-1, the slider 606 is slid forward into both the first portion of the second channel 604(2) and into a front portion of the first channel 604(1). A biasing element (e.g., spring 530) may be used to bias the slider in the locked configuration. As the slider 606 is moved toward a backmost position, the second sliding member 602(2) may move to the right. The second sliding member 602(2) may be biased (e.g., with a spring 530) toward the right (e.g., open or unlocked position), such that when the slider 606 is moved to the unlocked position, the second sliding member 602(2) automatically moves toward the unlocked configuration.

The slider 606 may act as a stop (e.g., stop 508). The slider 606 may keep the locking apparatus 600 in the locked configuration with or without a locking protrusion (e.g., locking protrusion 290) in the aperture 622. Without the slider 606, the sliding members 602 may slide between the locked and unlocked configurations without externally applied forces.

The sliding members 602 may include locking aperture assemblies 620. The first sliding member 602(1) is shown with a first locking aperture assembly 620(1). The second sliding member 602(2) may include a second locking aperture assembly (not shown). The second locking aperture assembly may be similar to the second locking aperture assembly 520(2) of FIGS. 5-2 and 5-4. The locking aperture assemblies 620 may cooperate to form an aperture 622, as best seen in FIG. 6-1. The first locking aperture assembly 620(1) forms a rectangular opening.

The aperture 622 formed by the locking aperture assemblies 620 may limit movement of the sliding members 602 when a locking protrusion (e.g., locking protrusion 290 shown in FIGS. 2-5 through 2-8) is inserted into the aperture 622. The locking aperture assemblies 620 may form an aperture 622 with a continuous inner surface 624. The inner surface 624 may abut the locking protrusion such that when a lateral force (e.g., lateral to a longitudinal axis of the locking protrusion) is applied, the inner surface 624 resists the force.

One or more components of the locking apparatus 600 described in connection with FIGS. 6-1 and 6-2 may be used instead of or in addition to one or more components of any locking apparatus described herein. For example, the slider 606 may be incorporated into one or more of the locking apparatus 200, 300, 400, 500 described in connection with FIGS. 2-1 through 5-6. In another example, the second locking aperture assembly 220(2) that forms a rectangular opening with an open bottom (e.g., two posts that are spaced apart) may replace one of the locking aperture assemblies 620 described in connection with FIGS. 6-1 and 6-2.

Figures 2, 3, 4, 5, 6, 7:
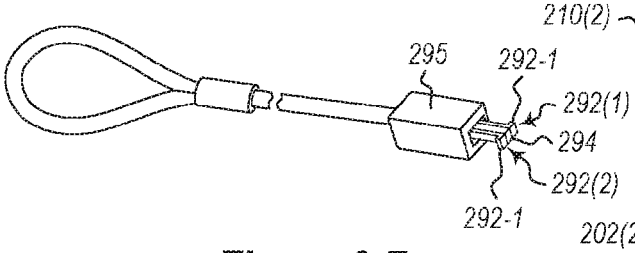

Referring generally to FIGS. 7-1 through 7-6, the locking apparatus 700 may be used to secure a computing device (e.g., computing device 101). The locking apparatus 700 of FIGS. 7-1 through 7-6 may be similar to the locking apparatuses described herein. Similar components may be similarly numbered.

The locking apparatus 700 may include two sliding members 702, as best seen in FIGS. 7-3 and 7-4. The second sliding member 702(2) includes a channel 704 and the first sliding member 702(1) includes a first slider 706(1) and a second slider 706(2).

The sliding members 702 include locking arms 710 that may be connected to and/or be integral with their respective sliding members 702. The locking arms 710 may include tabs 712. As shown, the first tab 712(1) and the second tab 712(2) extend toward each other and toward their respective locking arms 710. Thus, the locking arms 710 move toward each other as they transition from the unlocked configuration to the locked configuration and move away from each other as they transition from the locked configuration to the unlocked configuration. The first sliding member 702(1) includes a base member 714, shown in FIGS. 7-1 and 7-2 and in phantom in FIGS. 7-3 and 7-4 that is connected to a first locking arm 710(1).

The sliding members 702 may include locking aperture assemblies 720. The first sliding member 702(1) is shown with a first locking aperture assembly 720(1). The second sliding member 702(2) may include a second locking aperture assembly 720(2). The second locking aperture assembly may be similar to the second locking aperture assembly 520(2) of FIGS. 5-2 and 5-4. The locking aperture assemblies 720 may cooperate to form an aperture 722.

The first locking aperture assembly 720(1) and the second locking aperture assembly 720(2) each form a circular opening that extends parallel to the sliding direction. The aperture 722 formed by the locking aperture assemblies 720 may limit movement of the sliding members 702 when a locking protrusion (e.g., locking protrusion 290 shown in FIGS. 2-5 through 2-8) is inserted into the aperture 722. The locking aperture assemblies 720 may form an aperture 722 with a continuous inner surface 724. The inner surface 724 may abut the locking protrusion such that when a lateral force (e.g., lateral to a longitudinal axis of the locking protrusion) is applied, the inner surface 724 resists the force.

As shown in FIGS. 7-5 and 7-6, the locking apparatus 700 may connect to an embodiment of a base module 709. In other embodiments, the locking apparatus 700 may connect to another component of a computing device (e.g., computing device 101).

The tabs 712 are configured to engage respective locking receptacles 719. The locking apparatus 700 may be aligned with the electronic component 713 (shown in FIG. 7-6). For example, the electronic component 713 is shown as a power cord that is aligned vertically with the locking apparatus 700. Aligning the electronic component 713 with the locking apparatus 700 may reduce the footprint of the computing device (e.g., computing device 101).

FIG. 7-6 includes a locking protrusion assembly 780. The locking protrusion assembly 780 is shown with a lock 782, a locking cable 786, and a locking attachment 787. The lock 782 may connect to the locking cable 786. For example, the lock 782 may include internal tabs that may engage external detents in the locking cable 786. The lock 782 may be unlocked by keys and is shown in the locked configuration. The lock 782 may include an aperture engaging member 792. The aperture engaging member may prevent the lock 782 from being pulled through the aperture 722. The locking cable 786 may include a locking protrusion 790. The locking protrusion 790 may be the locking cable 786, such that when the locking cable 786 is inserted through the aperture 722, the locking cable 786 cannot be pulled transversely through the aperture 722. In other words, the aperture 722 restricts lateral movement of the locking cable 786 and thus the locking protrusion 790.

In other words, movement of a locking protrusion 790 (shown in FIG. 7-6) may be laterally restricted but longitudinally (e.g., parallel to a longitudinal axis of the aperture 722) permitted. In other words, in the embodiment of FIGS. 5-2 and 5-4, the surfaces 524 of the aperture 522 are continuous around lateral sides of the aperture 522 as well as at one end (e.g., the top side) of the aperture 522. In the present embodiment, no surface is provided to limit the depth that the locking protrusion 790 may enter into the aperture 722.

The locking apparatus 700 may include a stop 708, as best seen in FIGS. 7-3 and 7-4. The stop 708 may selectively abut a surface of the second sliding member 702(2). For example, the stop 708 abuts a left surface (not labeled) of a notch (not labeled) of the second sliding member 702(2) as shown in the locked configuration of FIG. 7-4. The stop 708 may keep the locking apparatus 700 in the locked configuration with or without a locking protrusion (e.g., locking protrusion 290) in the aperture 722. Without the stop 708, the sliding members 702 may slide between the locked and unlocked configurations without externally applied forces. The stop 708 may be connected to a biasing member (e.g., spring 730(1) and 730(2)).

The biasing member may bias the stop 708 toward the locked configuration or toward the unlocked configuration. For example, the biasing member may push the stop 708 toward the front of the locking apparatus 700 or away from the front of the locking apparatus 700. Thus, for an embodiment where the stop 708 is biased toward the locked configuration, after a user removed the locking protrusion 790, a user would pull back on the stop 708 to unlock the locking apparatus 700. In embodiments where the stop 708 is biased toward the unlocked configuration, after the user removed the locking protrusion 790, the stop 708 may disengage and the locking apparatus 700 would automatically transition toward the unlocked configuration.

The first sliding member 702(1) and the second sliding member 702(2) may be biased toward or away from each other. For example, as shown, a biasing member (e.g., spring 730(2)) may bias the second sliding member 702(2) away from the first sliding member 702(1). In other embodiments, a biasing member may bias the second sliding member 702(2) toward the first sliding member 702(1).

Similar to the locking aperture assemblies 520 of FIGS. 5-1 through 5-6, the locking aperture assemblies 720 may be moved to create the aperture 722 in the locked configuration. The motion of the locking aperture assemblies 520 is shown as being linear in the sliding direction. The motion of the locking aperture assemblies may be different, as with locking aperture assemblies 720. As shown, the first locking aperture assembly 720(1) may be stationary in both the locked and unlocked configurations. The second locking aperture assembly 720(2) may move relative to the first locking aperture assembly 720(1). As shown, the second locking aperture assembly 720(2) may pivot (e.g., about a point) away from the front of the locking apparatus 700 to disengage the stop 708 and may pivot toward the front of the locking apparatus 700 to engage the stop 708 and lock the locking apparatus 700.

One or more components of the locking apparatus 700 described in connection with FIGS. 7-1 and 7-2 may be used instead of or in addition to one or more components of any locking apparatus described herein. For example, the locking apparatus assemblies 720 may be incorporated into one or more of the locking apparatus 200, 300, 400, 500, 600 described in connection with FIGS. 2-1 through 6-2. In another example, the one or more of the tabs 712 may be oriented away from each other as shown with the tabs 212 in phantom in FIG. 2-1.

Figures 2, 3, 4, 5, 6, 7, 8:
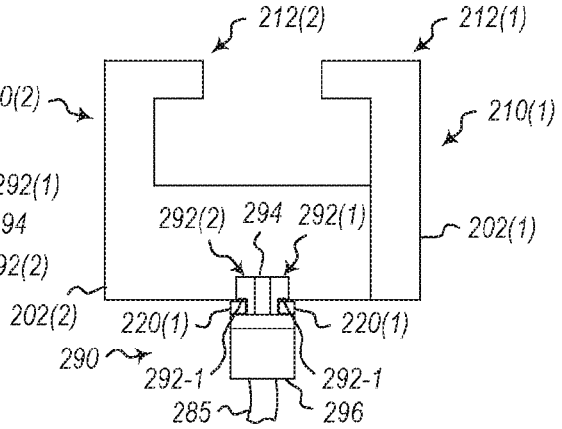
Figures 1, 3:
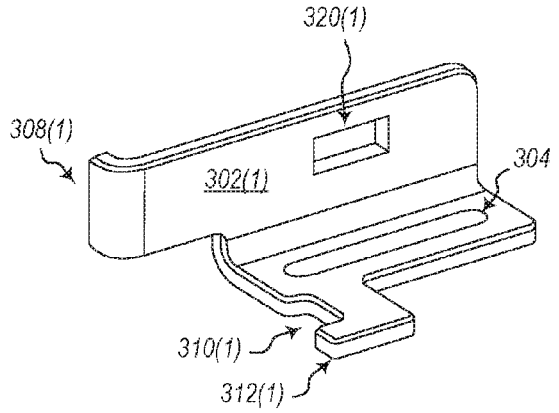
Figures 2, 3:
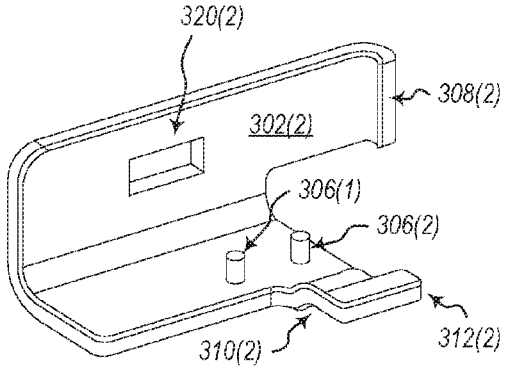
Figure 3:
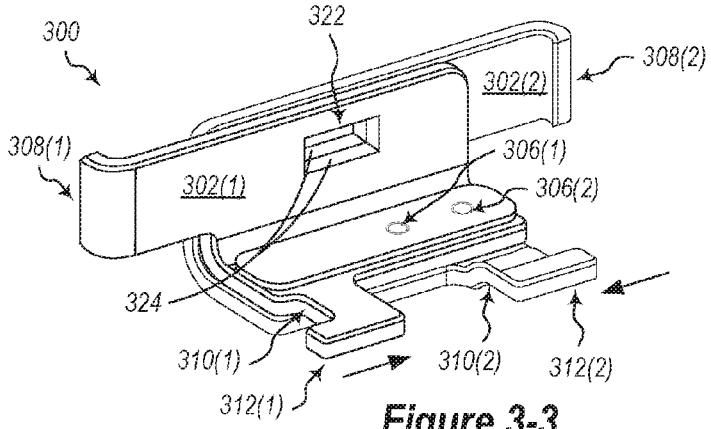
Figures 3, 4:
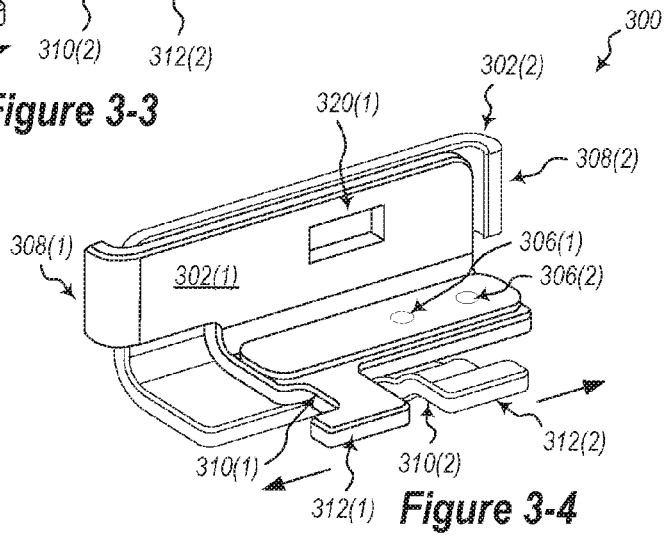
Figures 3, 4, 5:
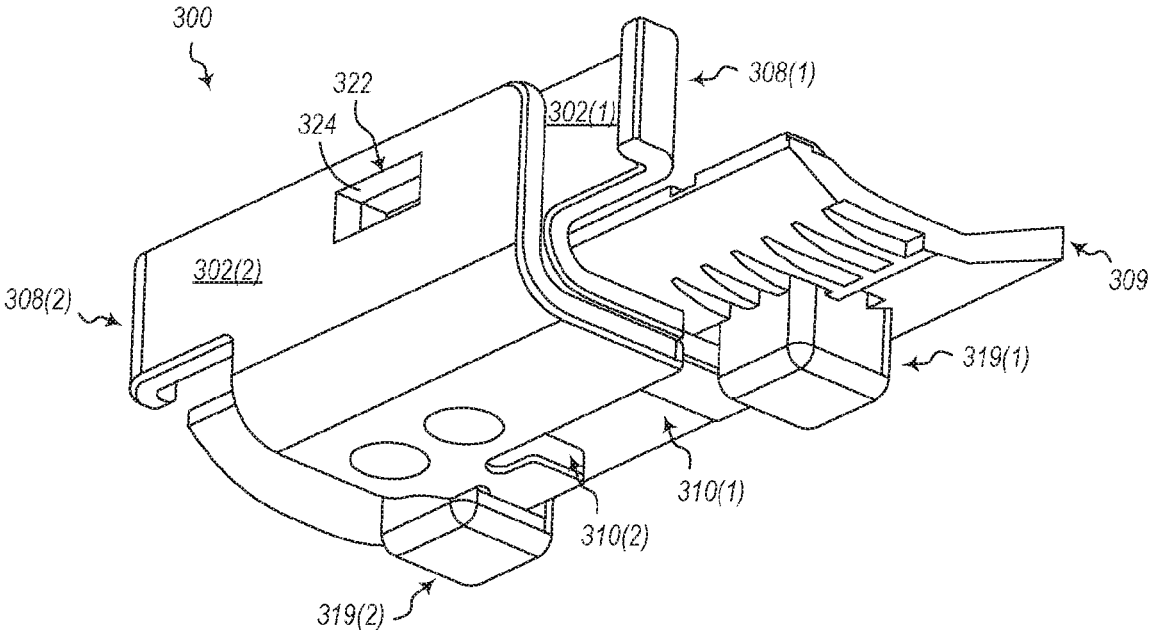
Figures 1, 4:
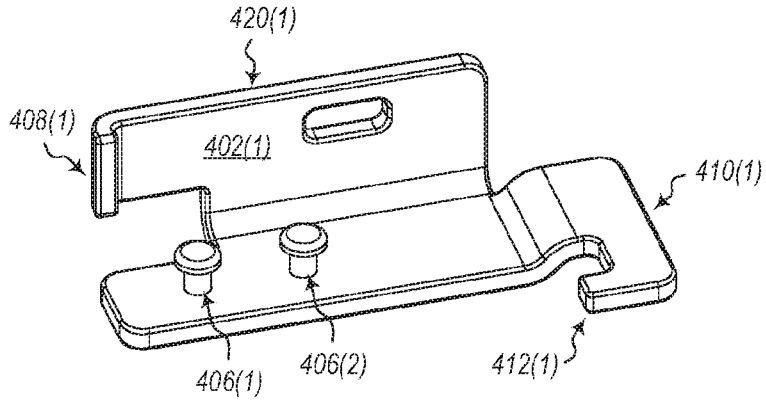
Figures 2, 4:
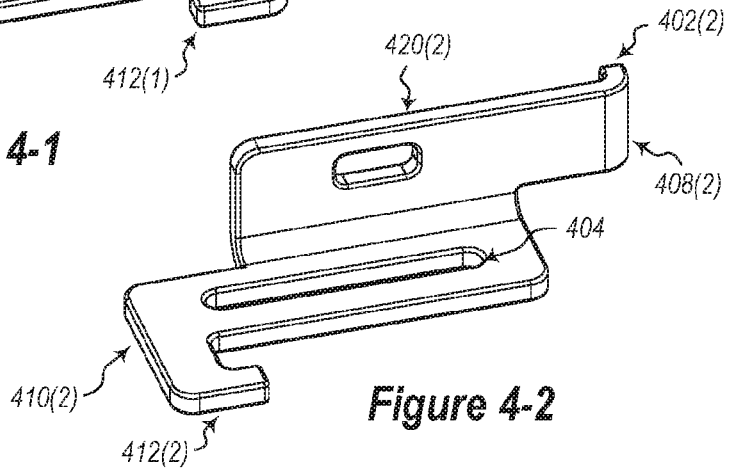
Figures 3, 4:
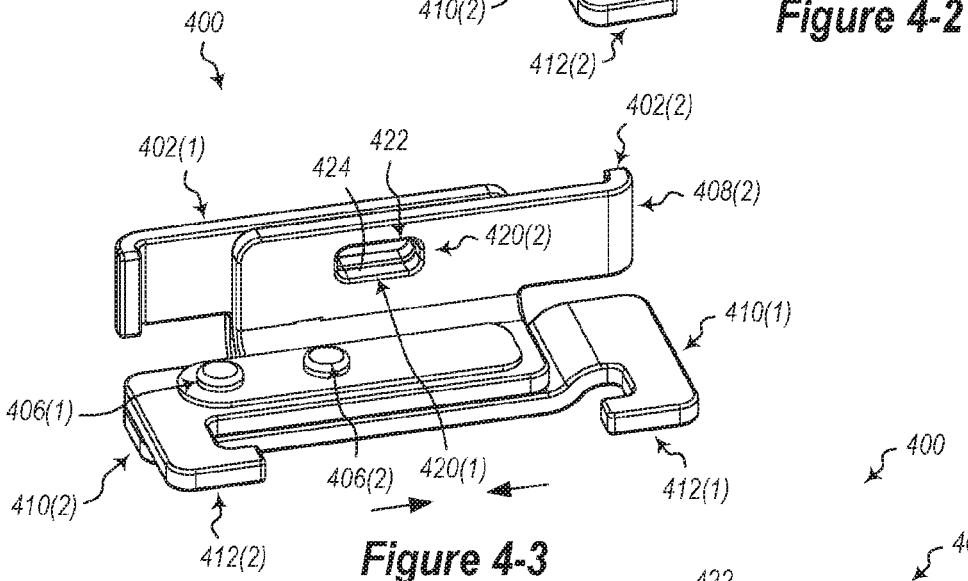
Figure 4:
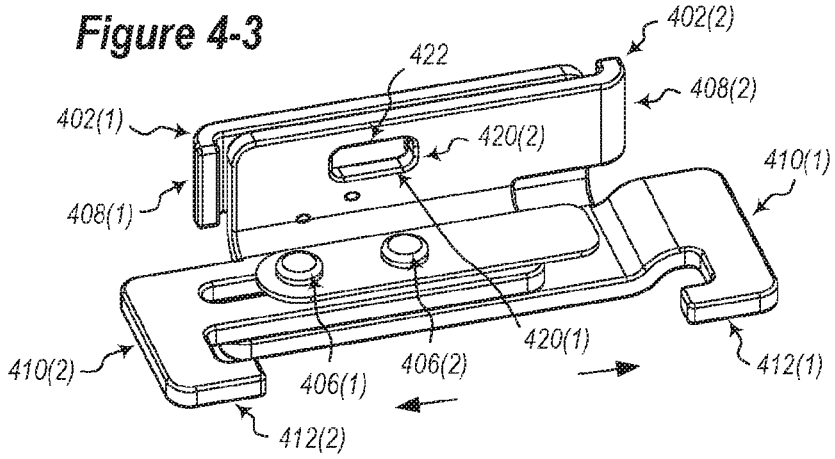
Figures 4, 5:
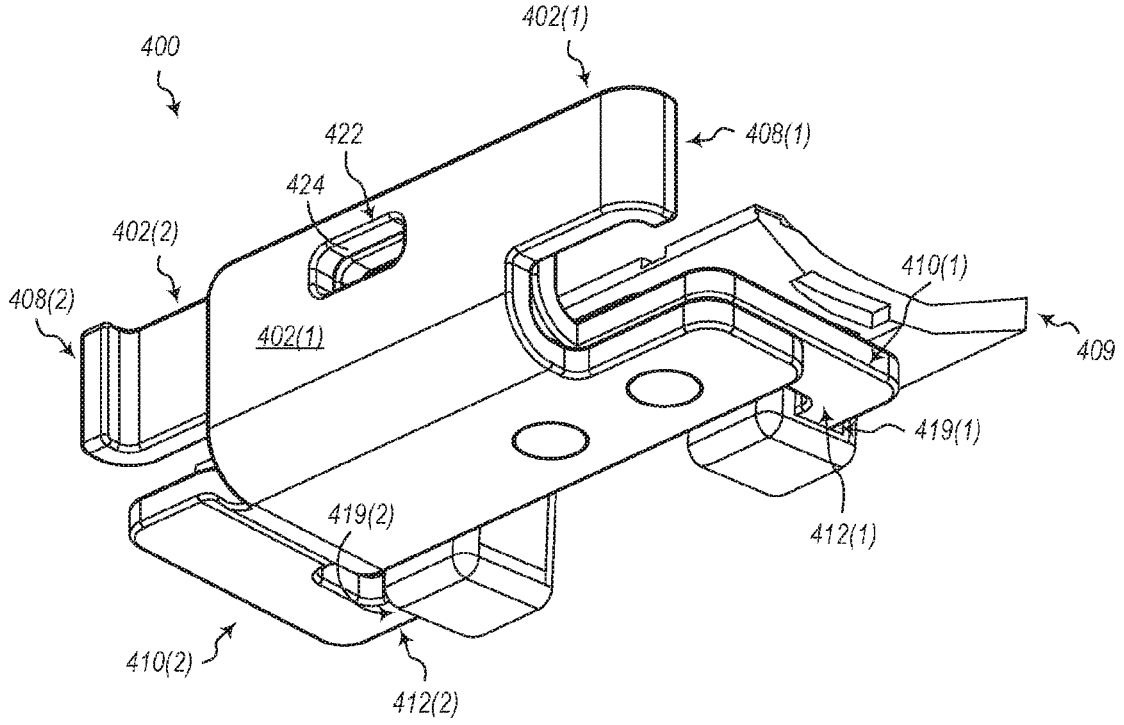
Figures 1, 5:
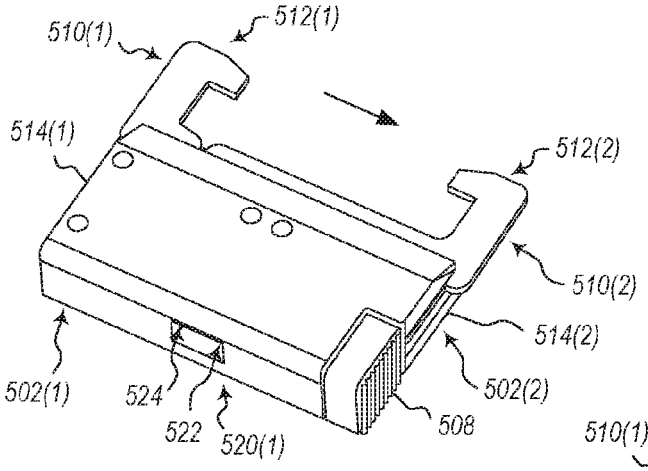
Figures 2, 5:
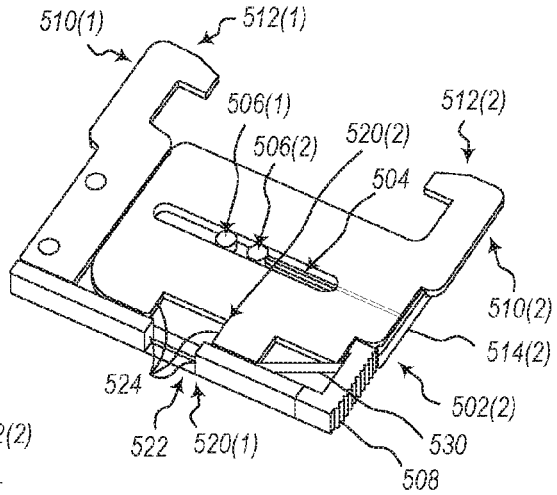
Figures 3, 5:
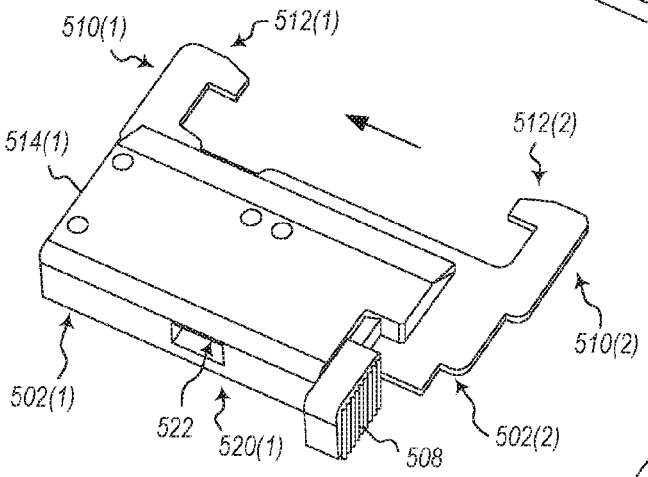
Figures 4, 5:
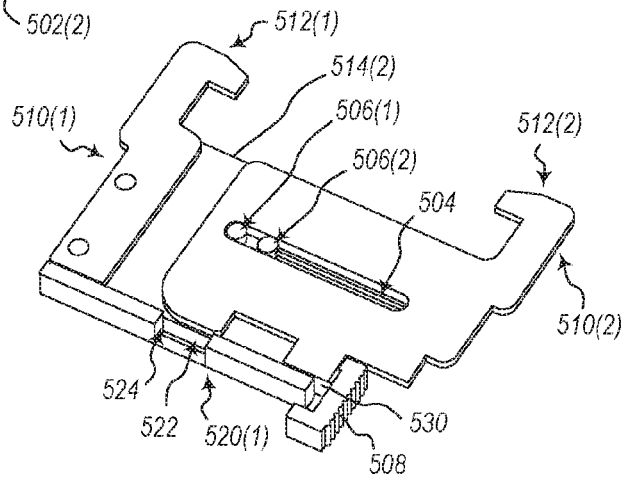
Figure 5:
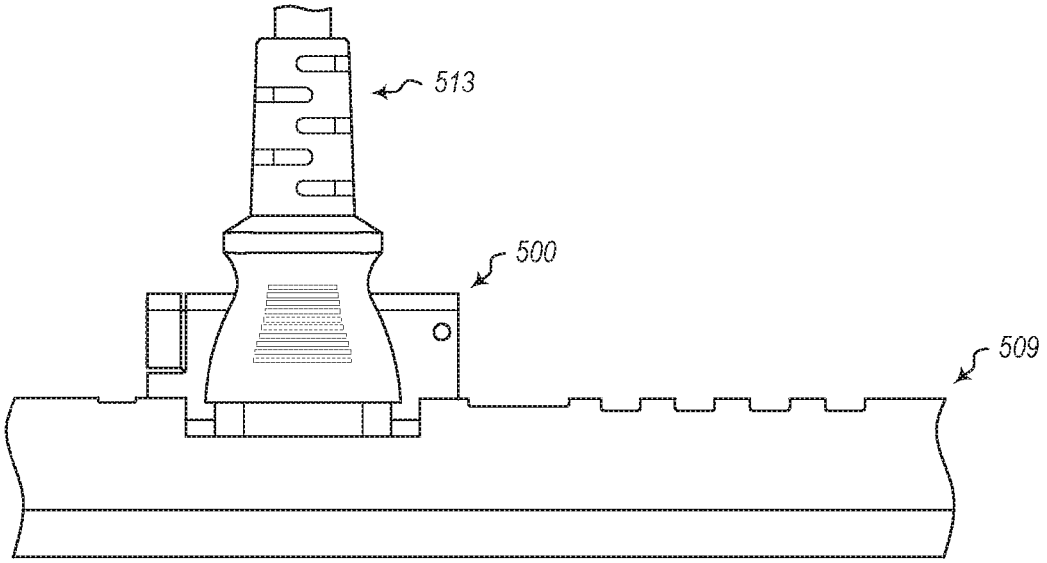
Figures 5, 6:
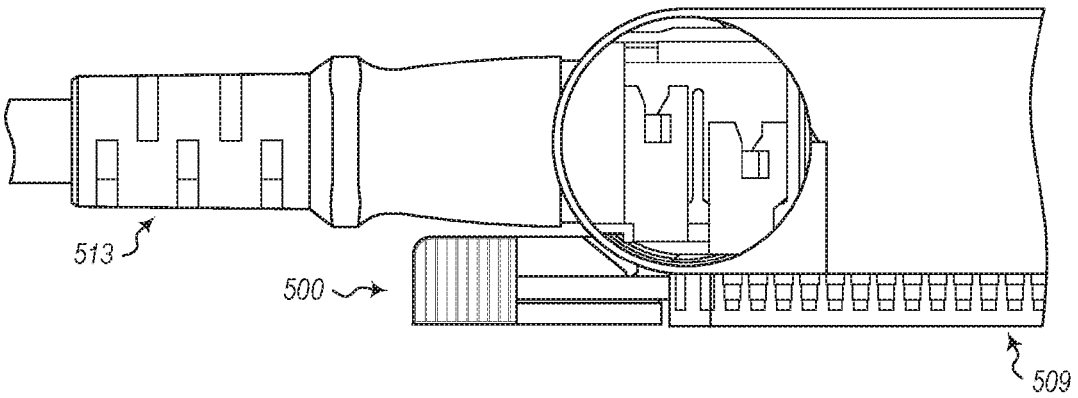
Figures 1, 6:
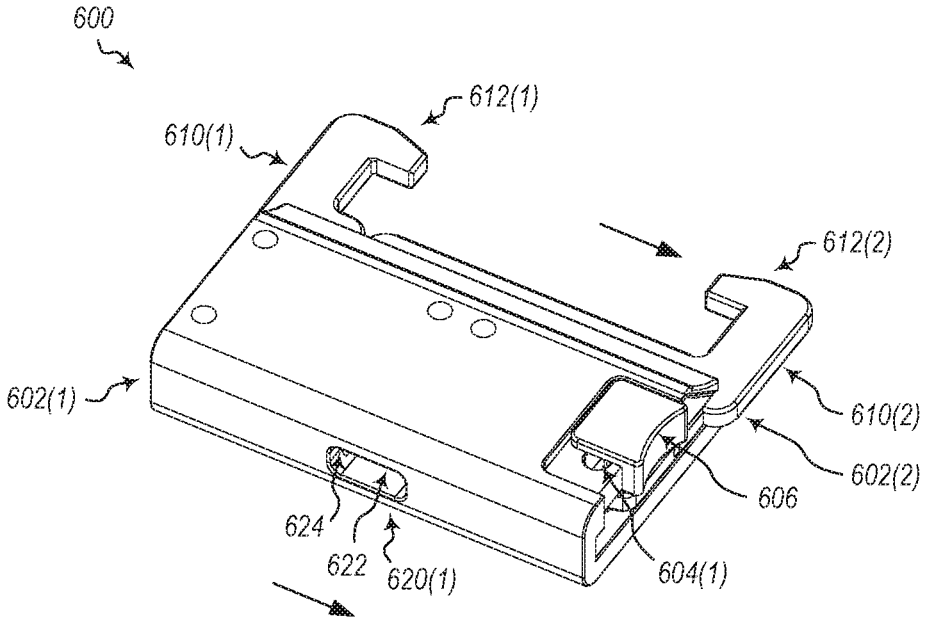
Figures 2, 6:
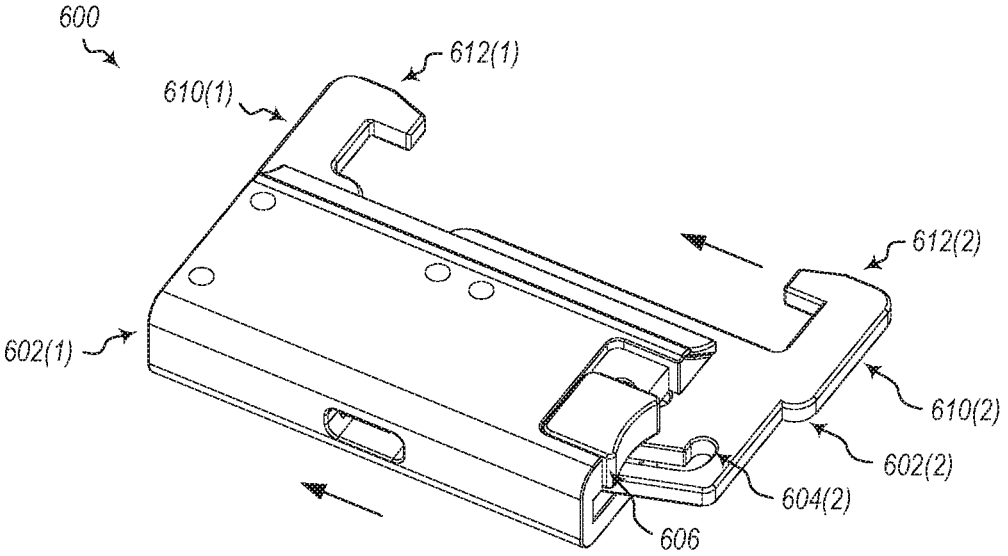
Figures 1, 7:
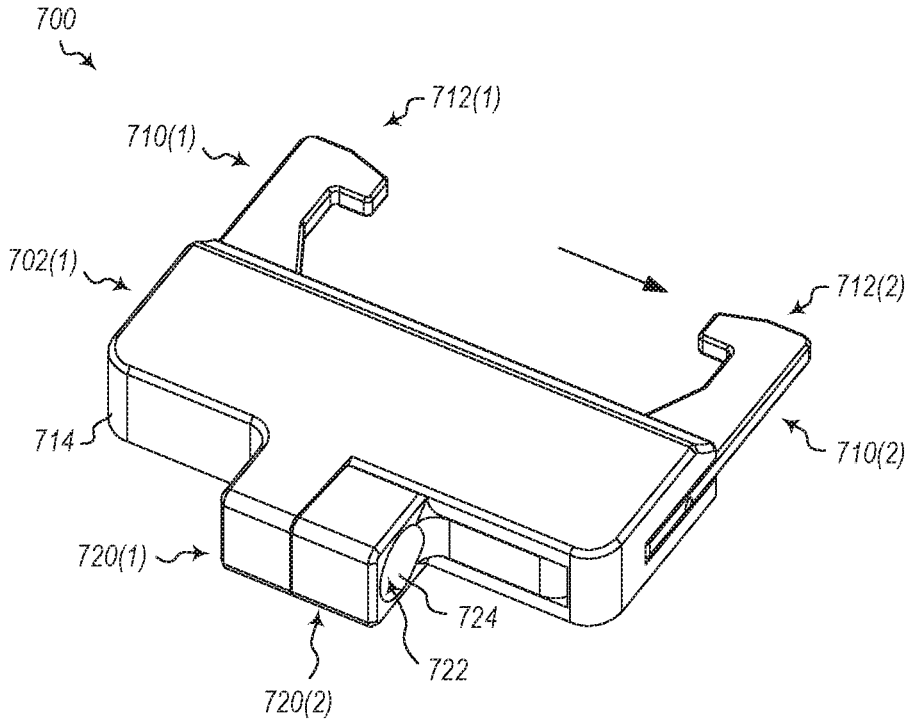
Figures 2, 7:
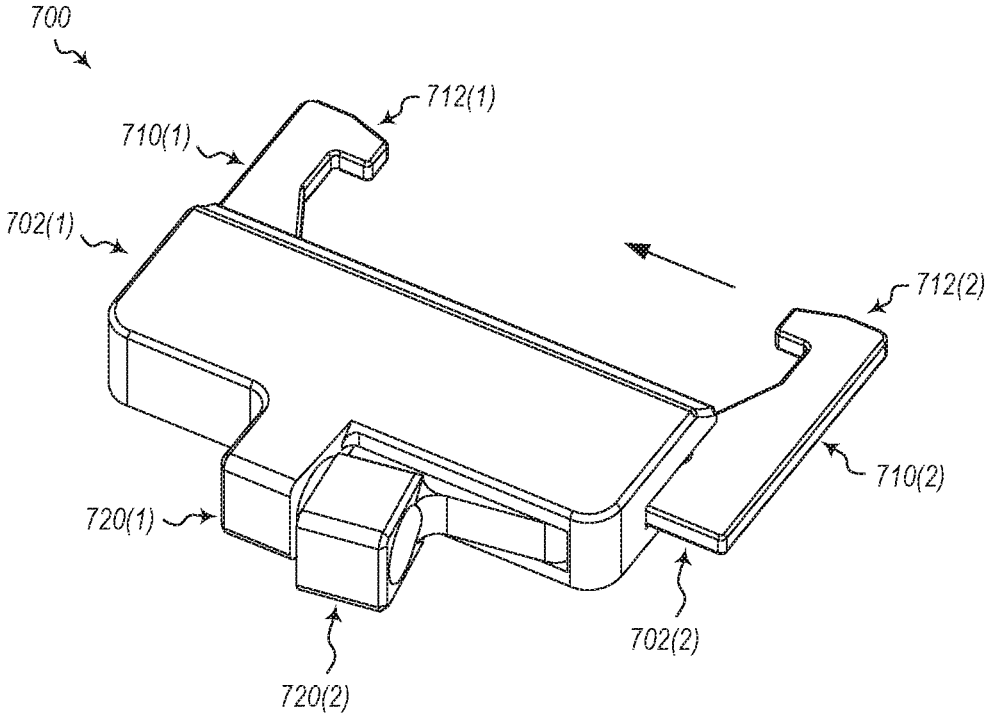
Figures 3, 7:
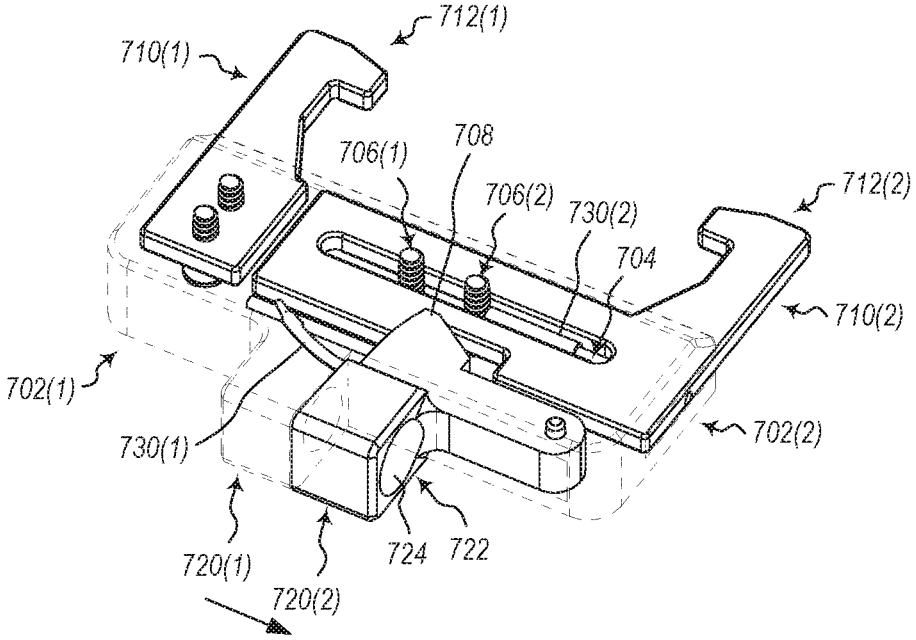
Figures 4, 7:
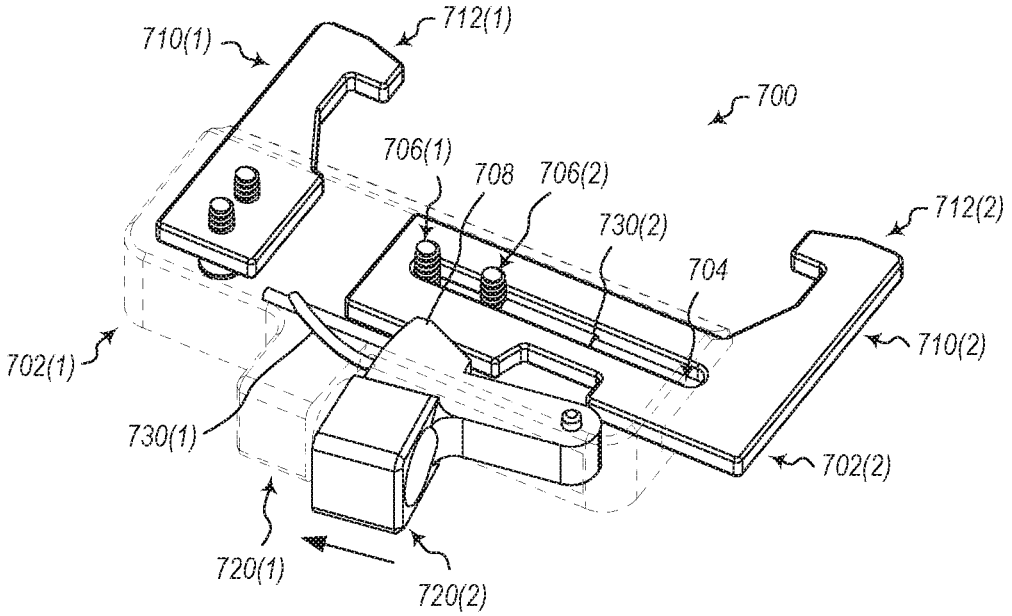
Figures 5, 7:
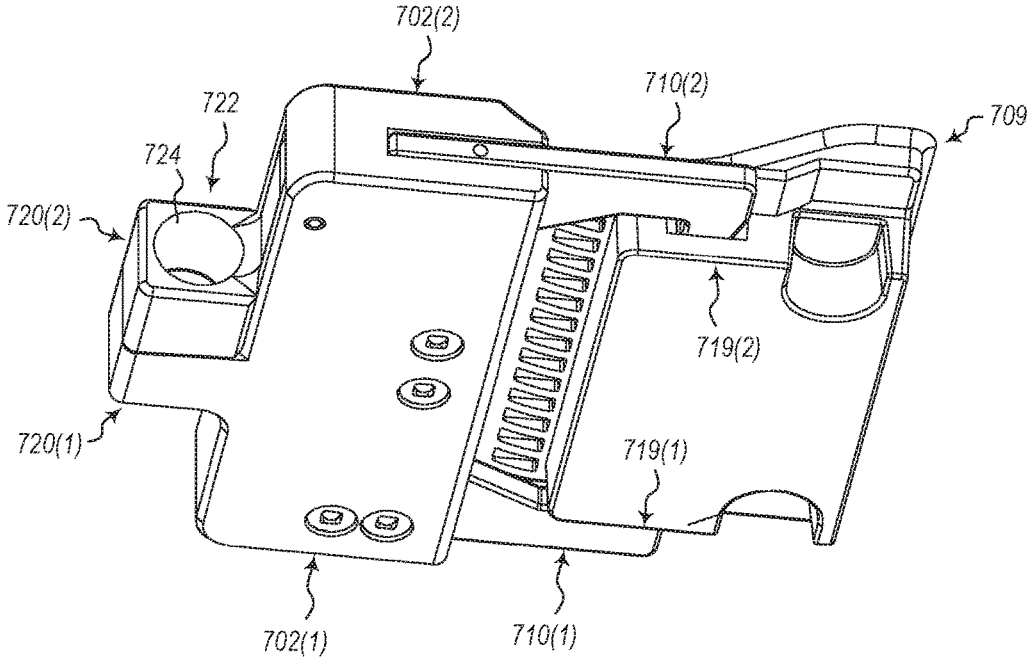
Figures 6, 7:
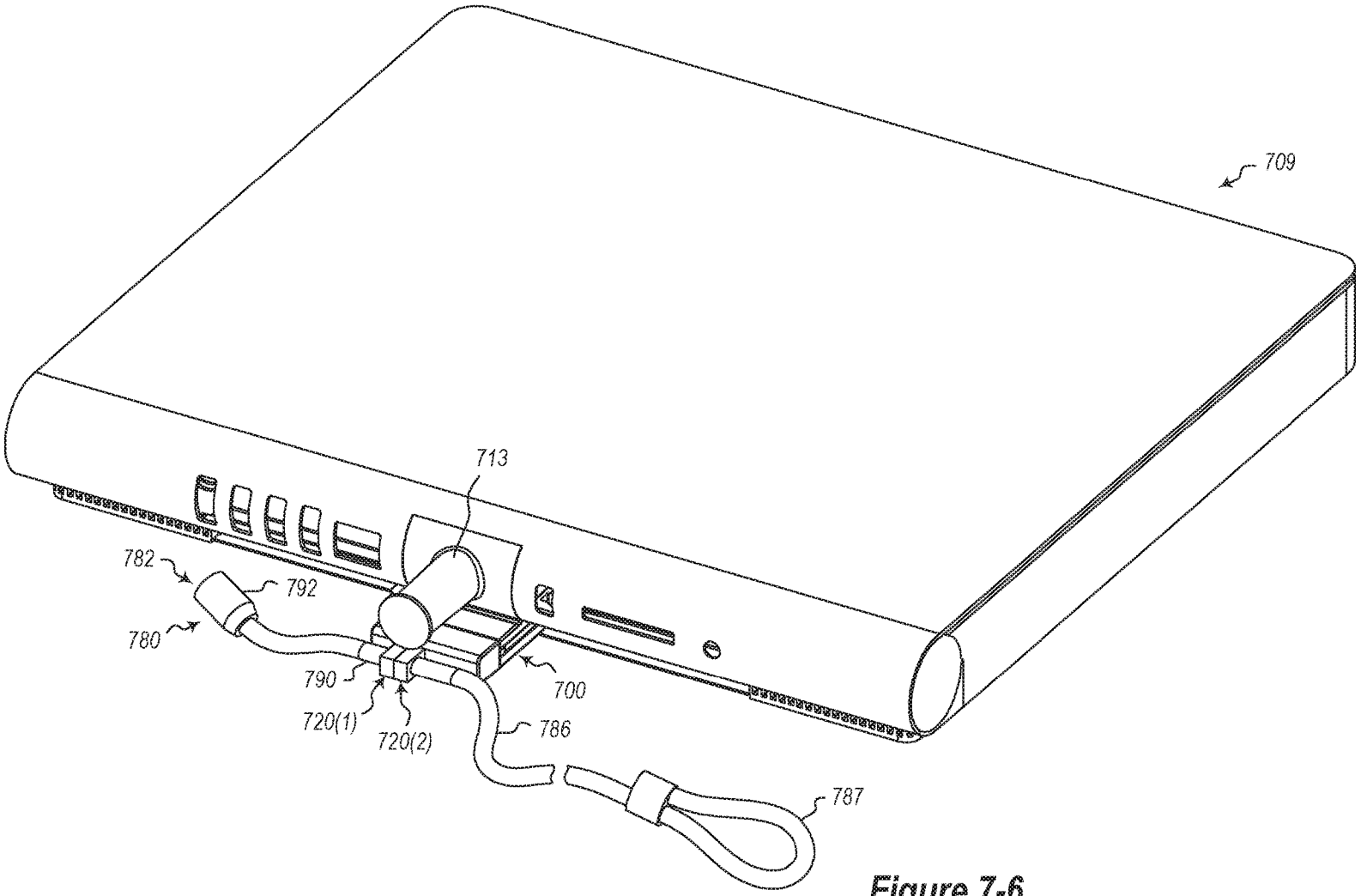
Figures 1, 8:
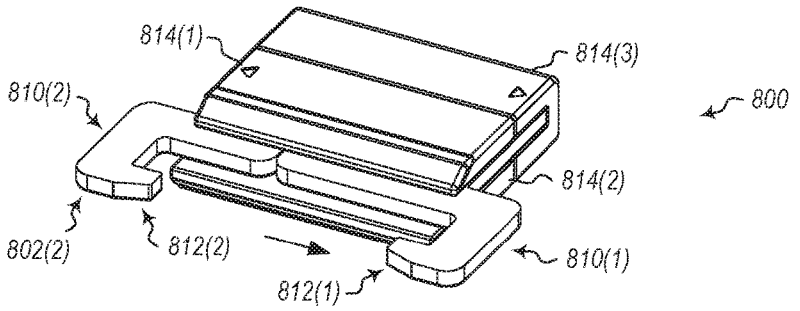
Figures 2, 8:
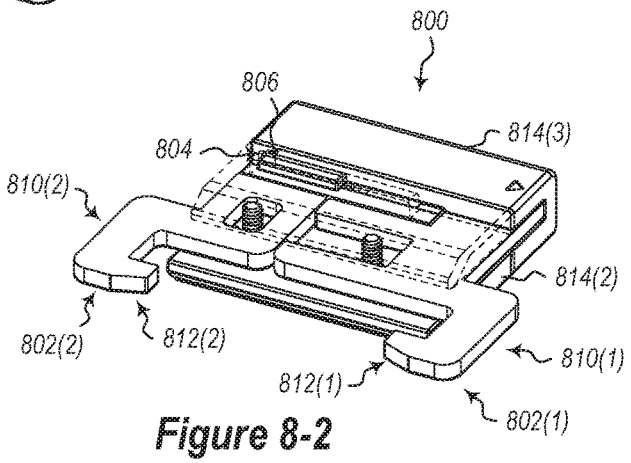
Figures 3, 8:
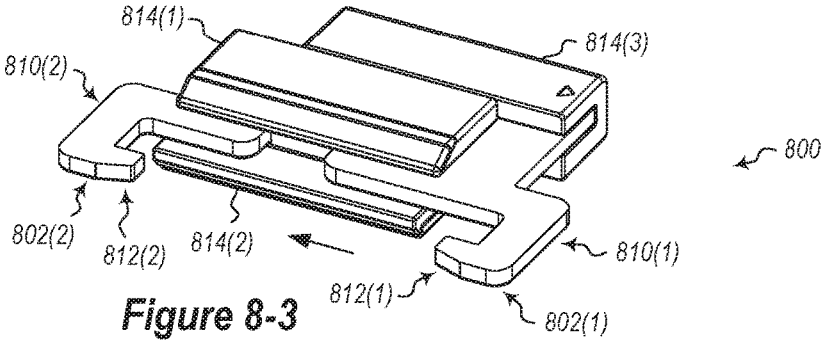
Figures 4, 8:
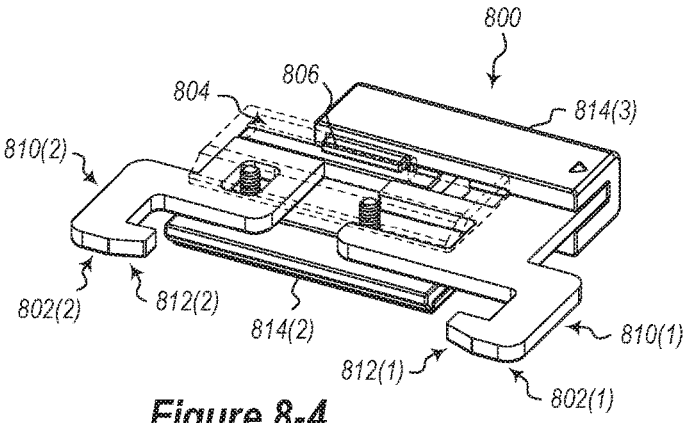
Figures 5, 8:
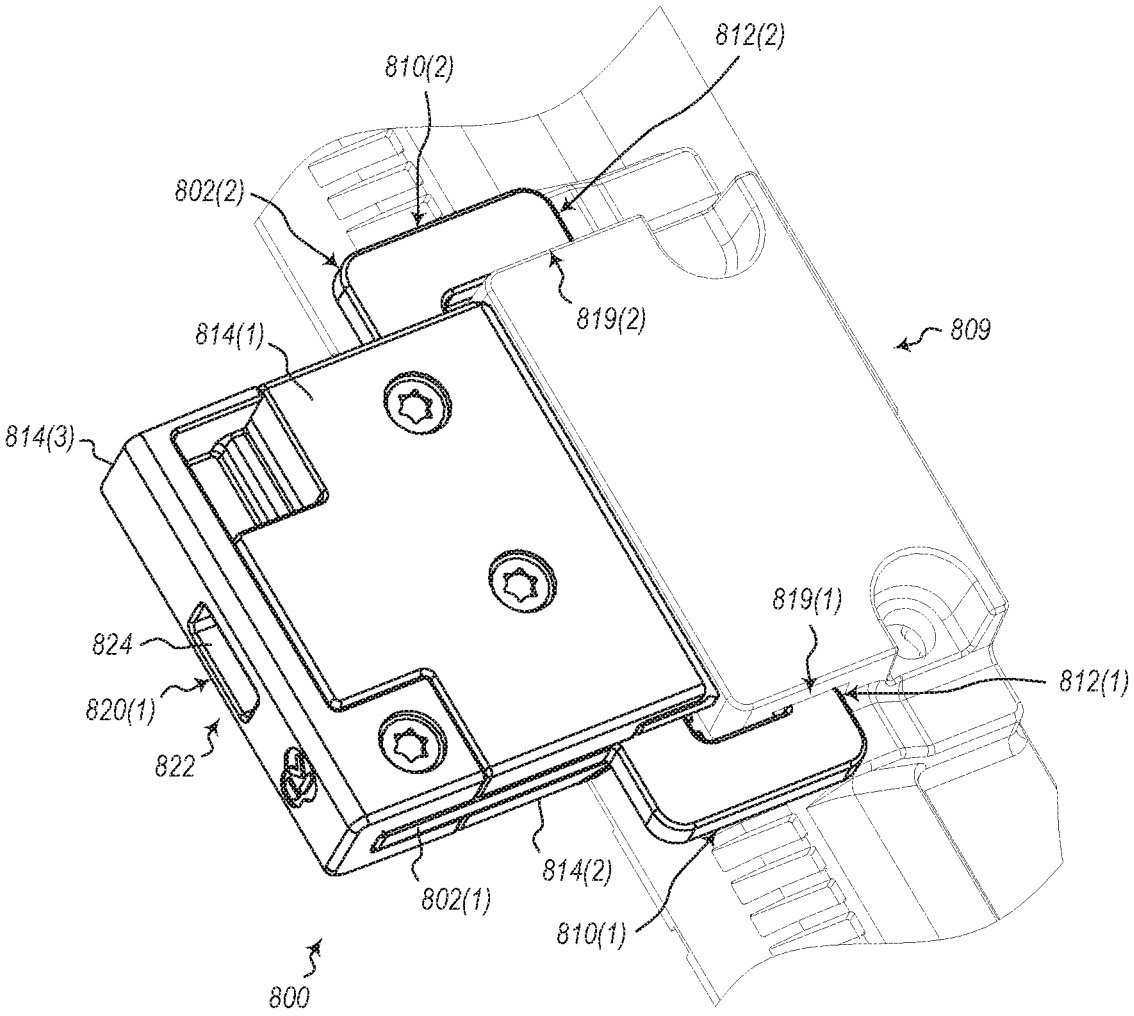
Figures 6, 8:
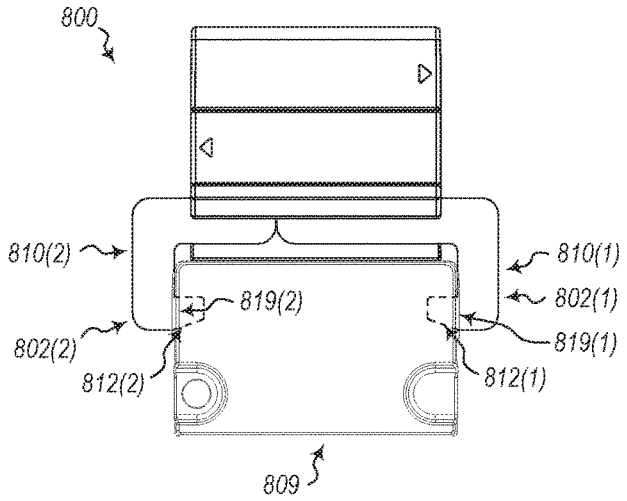
Figures 7, 8:
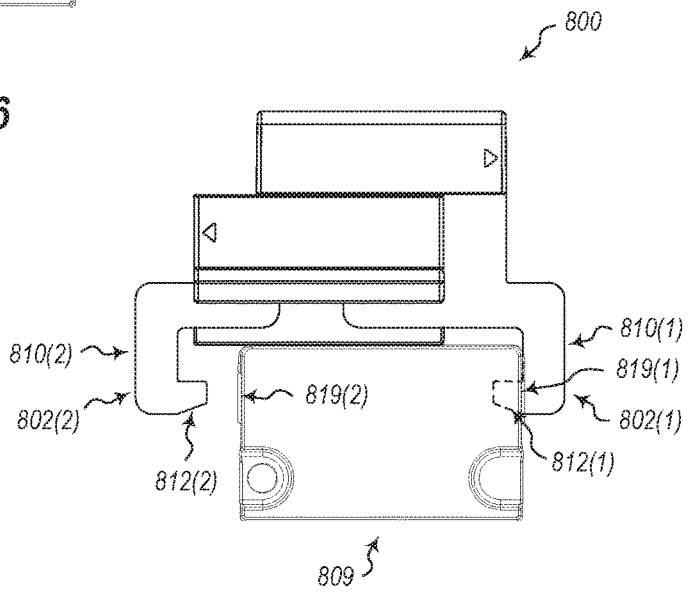
Figure 8:
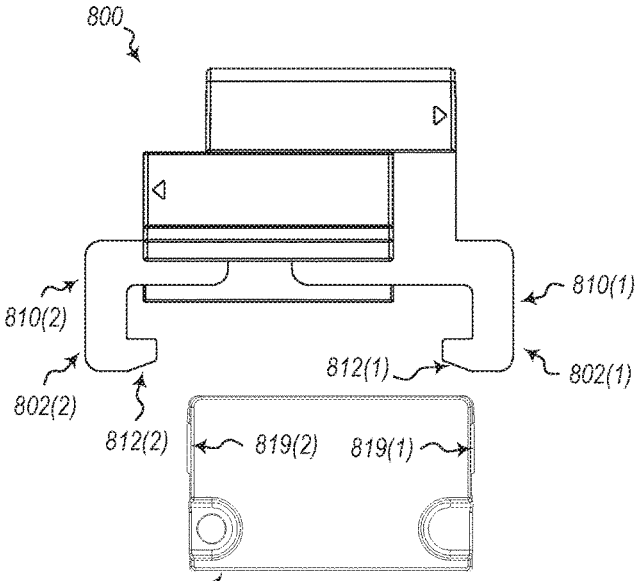

Referring generally to FIGS. 8-1 through 8-8, the locking apparatus 800 may be used to secure a computing device (e.g., computing device 101). The locking apparatus 800 of FIGS. 8-1 through 8-8 may be similar to the locking apparatuses described herein. Similar components may be similarly numbered.

The locking apparatus 800 may include two sliding members 802, as best seen in FIGS. 8-2 and 8-4. The second sliding member 802(2) includes an upper base member 814(1), shown in FIGS. 8-1 and 8-3, and a lower base member 814(2), best seen in FIGS. 8-2 and 8-4, which are connected to a second locking arm 810(2). The upper base member 814(1) may act as a cap, as described above in FIGS. 2-1 through 2-8. The first locking arm 810(1) may be connected to a rear base member 814(3). As shown in FIGS. 8-2 and 8-4, the rear base member 814(3) may include a slider 806. A corresponding channel 804 for the slider 806 may be included in a rear surface of the upper base member 814(1), shown partially cutaway in FIGS. 8-2 and 8-4.

The locking arms 810 may include tabs 812. As shown, the first tab 812(1) and the second tab 812(2) extend toward each other and toward their respective locking arms 810. Thus, the locking arms 810 move toward each other as they transition from the unlocked configuration to the locked configuration and move away from each other as they transition from the locked configuration to the unlocked configuration.

As shown in FIG. 8-5, the locking apparatus 800 may connect to an embodiment of a base module 809. In other embodiments, the locking apparatus 800 may connect to another component of a computing device (e.g., computing device 101). The tabs 812 are configured to engage respective locking receptacles 819.

Although the locking apparatus 800 is not shown with a stop or biasing elements, in other embodiments, the locking apparatus 800 may include one or more stops (e.g., stops 308, 408, 508, 708, slider 606) and/or one or more biasing elements to bias the locking apparatus 800 toward the locked configuration or the unlocked configuration. Without stops, the sliding members 802 may slide between the locked and unlocked configurations without externally applied forces.

The sliding members 802 may include locking aperture assemblies 820, as best seen in FIG. 8-5. The first sliding member 802(1) is shown with a first locking aperture assembly 820(1). The second sliding member 802(2) may include a second locking aperture assembly (not shown). The second locking aperture assembly may be similar to the second locking aperture assembly 520(2) of FIGS. 5-2 and 5-4. The locking aperture assemblies 820 may cooperate to form an aperture 822, as best seen in FIG. 8-5. The first locking aperture assembly 820(1) forms a rectangular opening.

The aperture 822 formed by the locking aperture assemblies 820 may limit movement of the sliding members 802 when a locking protrusion (e.g., locking protrusion 290 shown in FIGS. 2-5 through 2-8) is inserted into the aperture 822. The locking aperture assemblies 820 may form an aperture 822 with a continuous inner surface 824. The inner surface 824 may abut the locking protrusion such that when a lateral force (e.g., lateral to a longitudinal axis of the locking protrusion) is applied, the inner surface 824 resists the force.

One or more components of the locking apparatus 800 described in connection with FIGS. 8-1 through 8-8 may be used instead of or in addition to one or more components of any locking apparatus described herein. For example, the slider 806 and channel 804 may be incorporated into one or more of the locking apparatus 200, 300, 400, 500, 600, 700 described in connection with FIGS. 2-1 through 7-6. In another example, the one or more of the tabs 812 may be oriented away from each other as shown with the tabs 212 in phantom in FIG. 2-1. In a further example, the locking aperture assemblies 720 of FIGS. 7-1 through 7-6 may be incorporated into the locking apparatus 800.

One or more components of the embodiments described herein may be provided in a kit. For example, the locking apparatus 800 of FIG. 8-1 through 8-8 may be provided with locking protrusion assembly 280 of FIG. 2-5

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A locking apparatus comprising:

a first sliding member, the first sliding member including:

a first locking arm extending from the first sliding member;

a first tab extending from the first locking arm; and a first locking aperture assembly having at least one first post extending transversely from the first locking arm; and a second sliding member, the second sliding member including:

a second locking arm extending from the second sliding member;

the second sliding member connected to the first sliding member such that the first sliding member is slideable relative to the second sliding member in a sliding direction; and a second locking aperture assembly having at least one second post extending transversely from the second locking arm, the at least one second post configured to cooperate with the at least one first post to form an aperture, the at least one first post and the at least one second post configured to prevent relative motion between the first sliding member and the second sliding member when a locking protrusion is inserted therethrough in a locked configuration and allow relative motion between the first sliding member and the second sliding member when the locking protrusion is removed in an unlocked configuration.

2. The locking apparatus of claim 1, wherein the first locking arm and the second locking arm extend transversely to the sliding direction.

3. The locking apparatus of claim 1, wherein the first tab extends transversely from the first locking arm in the sliding direction toward the second locking arm.

4. The locking apparatus of claim 1, wherein the first tab extends transversely from the first locking arm in the sliding direction away from the second locking arm.

5. The locking apparatus of claim 1, wherein the aperture includes a continuous inner surface in the locked configuration.

6. The locking apparatus of claim 1, wherein the first sliding member includes a channel and the second sliding member includes a slider that rides within the channel, the channel defining the sliding direction.

7. The locking apparatus of claim 1, further comprising a second tab extending from the second locking arm.

8. The locking apparatus of claim 7, wherein the second tab extends transversely from the second locking arm in the sliding direction toward or away from the first tab.

9. The locking apparatus of claim 1, wherein two of the one or more second posts extend to form an entire surface surrounding the aperture formed by the one or more second posts.

10. A locking system, the system comprising:

a computing device having a first locking receptacle and a second locking receptacle;

a locking apparatus including:

a first sliding member, the first sliding member including:

a first locking arm extending from the first sliding member;

a first tab extending from the first locking arm, the first tab configured to engage the first locking receptacle of the computing device; and a first locking aperture assembly; and a second sliding member, the second sliding member connected to the first sliding member such that the first sliding member is configured to slide along a linear path relative to the second sliding member in a linear sliding direction, the second sliding member including:

a second locking arm extending from the second sliding member;

a second tab extending from the second locking arm, the second tab configured to engage the second locking receptacle of the computing device such that when the locking apparatus is in a locked configuration the first tab and the second tab cooperate to limit relative motion between the locking apparatus and the computing device in a direction transverse to the sliding direction, the second locking arm configured to engage the computing device such that the first locking arm and the second locking arm cooperate to limit relative motion between the locking apparatus and the computing device in the sliding direction in the locked configuration; and a second locking aperture assembly configured to cooperate with the first locking aperture assembly to form an aperture, the first locking aperture assembly and the second locking aperture assembly configured to allow relative motion between the first sliding member and the second sliding member in an unlocked configuration; and a locking protrusion configured to extend into and through the aperture in the locked configuration and configured to engage at least a portion of the aperture to prevent relative motion in the sliding direction between the first sliding member and the second sliding member in the locked configuration.

11. The system of claim 10, wherein the first locking receptacle and the second locking receptacle lie within a plane.

12. The system of claim 11, wherein the plane within which the first locking receptacle and the second locking receptacle lie is parallel to and offset from a plane in which an electronic component lies.

13. The system of claim 10, further comprising a stop configured to maintain the locking apparatus in the locked configuration without a locking protrusion inserted through the aperture.

14. The system of claim 10, further comprising a biasing member configured to bias the locking apparatus toward the locked configuration or the unlocked configuration.

15. A kit for securing a computing device, comprising:

a locking apparatus including:

a first sliding member, the first sliding member including:

a first locking arm extending from the first sliding member;

a first tab extending from the first locking arm;

a channel; and a first locking aperture assembly; and a second sliding member, the second sliding member including:

a second locking arm extending from the second sliding member;

a slider configured to move in a linear path within the channel, the channel configured to limit the motion of the slider within the channel;

the second sliding member connected to the first sliding member such that the first sliding member is configured to slide relative to the second sliding member in a sliding direction, the first tab configured to engage one or more locking receptacles of a computing device such that when the locking apparatus is in a locked configuration the first tab limits relative motion between the locking apparatus and the computing device in a first direction, the second locking arm configured to engage the computing device such that the first locking arm and the second locking arm cooperate to limit relative motion between the locking apparatus and the computing device in a second direction; and a second locking aperture assembly configured to cooperate with the first locking aperture assembly to form an aperture with a top surface, a bottom surface, a left surface, and a right surface in a locked configuration, the first locking aperture assembly and the second locking aperture assembly configured to allow relative motion between the first sliding member and the second sliding member in an unlocked configuration, the first sliding member and the second sliding member sliding a first distance from the unlocked configuration to the locked configuration; and a locking protrusion configured to extend into and through the aperture in the locked configuration and configured to engage at least a portion of the aperture to prevent relative motion between the first sliding member and the second sliding member in the locked configuration.

16. The kit of claim 15, wherein the locking protrusion includes one or more aperture engaging members configured to limit motion of the locking protrusion out of the aperture.

17. The kit of claim 15, further comprising a lock configured to lock the locking protrusion to the aperture of the locking apparatus.

18. The kit of claim 17, further comprising keys configured to open the lock.

19. The kit of claim 15, further comprising a locking cable connected to the locking protrusion.

20. The kit of claim 19, wherein the locking cable includes a locking attachment.

* * * * *